US008026938B2

(12) United States Patent
Mito

(10) Patent No.: US 8,026,938 B2
(45) Date of Patent: Sep. 27, 2011

(54) THERMAL PRINTER

(75) Inventor: Kenji Mito, Tokyo (JP)

(73) Assignee: Citizen Holdings Co., Ltd., Tokyo (JP)

( * ) Notice: Subject to any disclaimer, the term of this patent is extended or adjusted under 35 U.S.C. 154(b) by 445 days.

(21) Appl. No.: 12/302,392

(22) PCT Filed: Aug. 28, 2007

(86) PCT No.: PCT/JP2007/066636

§ 371 (c)(1),
(2), (4) Date: Nov. 25, 2008

(87) PCT Pub. No.: WO2008/078433

PCT Pub. Date: Jul. 3, 2008

(65) Prior Publication Data

US 2010/0253758 A1 Oct. 7, 2010

(30) Foreign Application Priority Data

Dec. 26, 2006 (JP) ..... 2006-349212

(51) Int. Cl.
*B41J 2/36* (2006.01)

(52) U.S. Cl. ..... 347/180; 347/218

(58) Field of Classification Search ..... 347/180, 347/181, 182, 218; 400/120.05, 120.06
See application file for complete search history.

(56) References Cited

FOREIGN PATENT DOCUMENTS

| | | | | |
|---|---|---|---|---|
| JP | 63-009562 | * | 1/1988 | ..... 347/182 |
| JP | 2-62250 | A | 3/1990 | |
| JP | 7-134234 | A | 5/1995 | |
| JP | 7-323597 | A | 12/1995 | |
| JP | 8-25291 | B2 | 3/1996 | |
| JP | 2002-321411 | A | 11/2002 | |
| JP | 2005-313481 | A | 11/2005 | |
| JP | 2008-155563 | A | 7/2008 | |
| JP | 4111455 | B1 | 7/2008 | |

OTHER PUBLICATIONS

International Search Report of PCT/JP2007/066636, date of mailing Oct. 30, 2007.

Notification of Transmittal of Translation of the International Preliminary Report on Patentability (Form PCT/IB/338) of International Application No. PCT/JP2007/066636 mailed Jul. 9, 2009 with Forms PCT/IB/326, PCT/IB/373 and PCT/ISA/237.

* cited by examiner

*Primary Examiner* — Huan Tran
(74) *Attorney, Agent, or Firm* — Westerman, Hattori, Daniels & Adrian, LLP

(57) ABSTRACT

When printing is performed by dividing a thermal printer head into segmented blocks, the number of dots to be printed in one line is changed, depending on the case, high-speed printing with a small division number of the segmented blocks, or low-speed printing with a large division number of the segmented blocks. When the division number of the segmented blocks is large and printing is performed at a low speed, paper feeding within one line is performed by multiple pitches to prevent the paper sheet from halting in one line, and energization is performed for each pitch to prevent occurrence of gaps between dots and between lines, by increasing the number of dots to be printed in one line. In the multiple pitches in one line, the ratio of energization amount to be fed in each pitch is changed to reduce a difference in density among pitches in one line. Accordingly, when printing is performed by using segmented blocks of the thermal printer head, even though the division number of the segmented blocks is large and printing is performed at a low speed, printing without generating a gap between dots is possible.

17 Claims, 20 Drawing Sheets

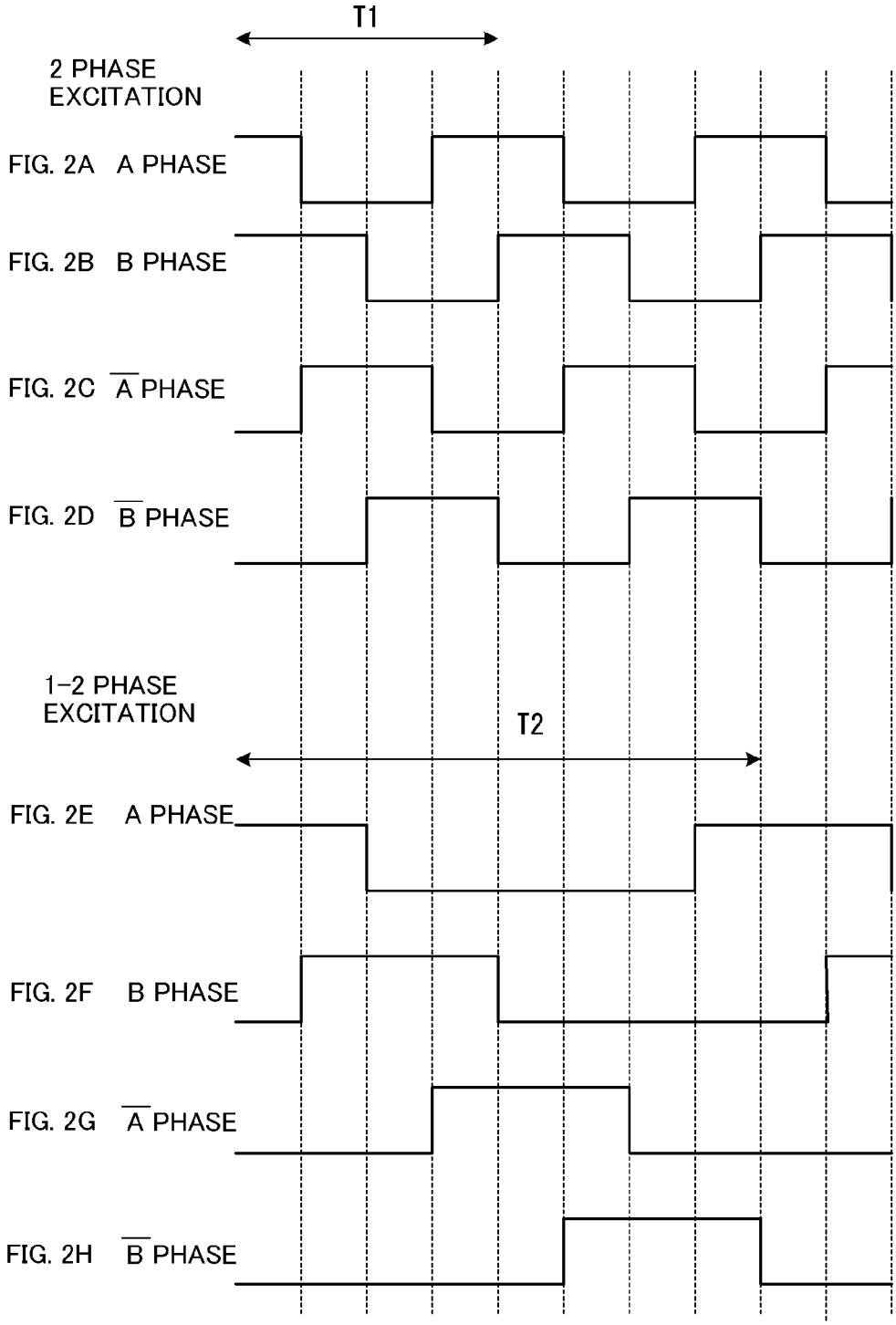
T1
2 PHASE EXCITATION
FIG. 2A A PHASE
FIG. 2B B PHASE
FIG. 2C $\overline{A}$ PHASE
FIG. 2D $\overline{B}$ PHASE
1-2 PHASE EXCITATION
T2
FIG. 2E A PHASE
FIG. 2F B PHASE
FIG. 2G $\overline{A}$ PHASE
FIG. 2H $\overline{B}$ PHASE FIG. 3A 2 PHASE EXCITATION
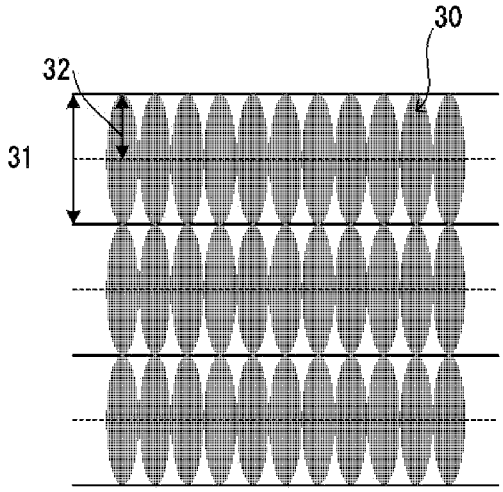
FIG. 3B 1-2 PHASE EXCITATION
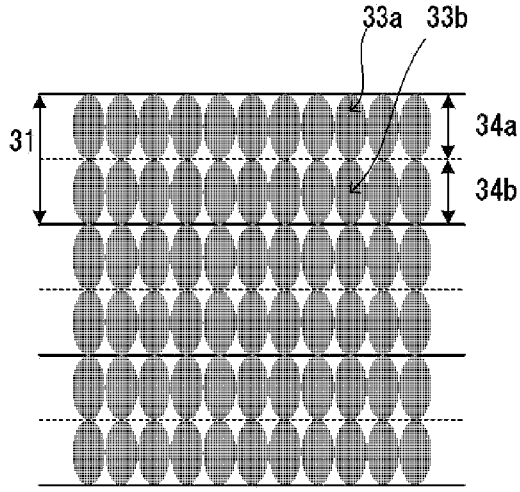

1-2 PHASE EXCITATION
2 PHASE EXCITATION
1 LINE
1 LINE
50:50
60:40
50:50
A PHASE
T a
B PHASE
T b
STB1
STB1

FIG. 5A ENERGIZATION RATIO 50:50
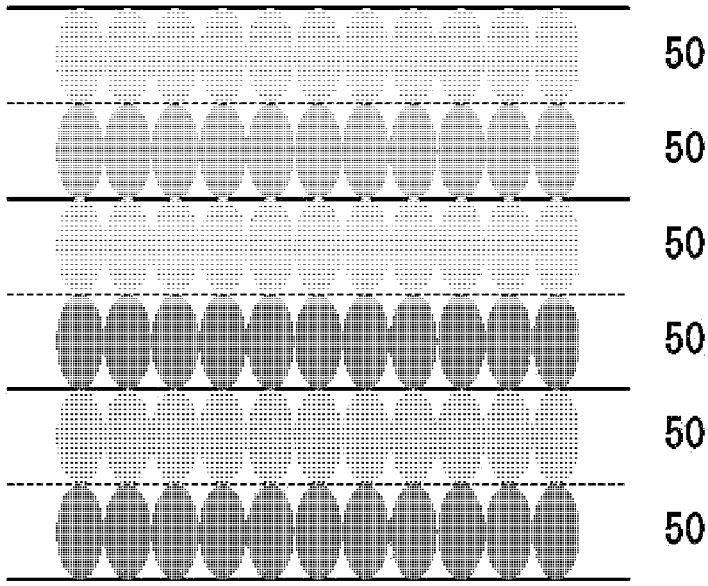
FIG. 5B ENERGIZATION RATIO 80:20
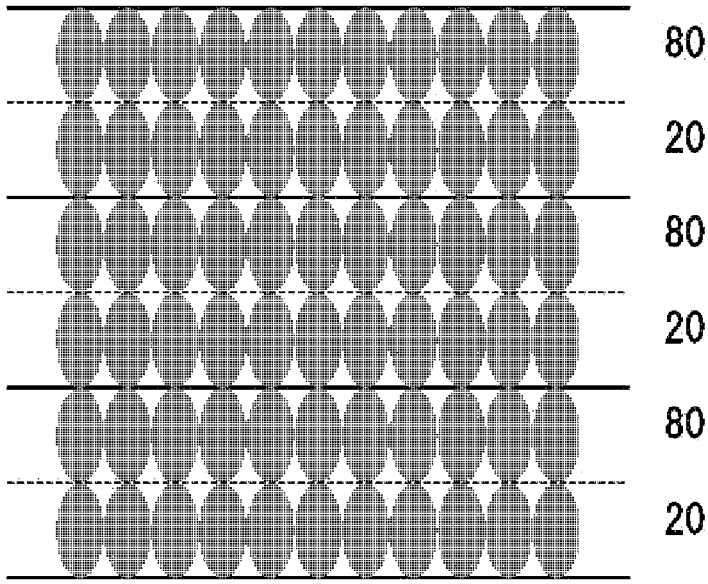

2 PHASE EXCITATION 1-2 PHASE EXCITATION 1-2 PHASE EXCITATION 1-2 PHASE EXCITATION

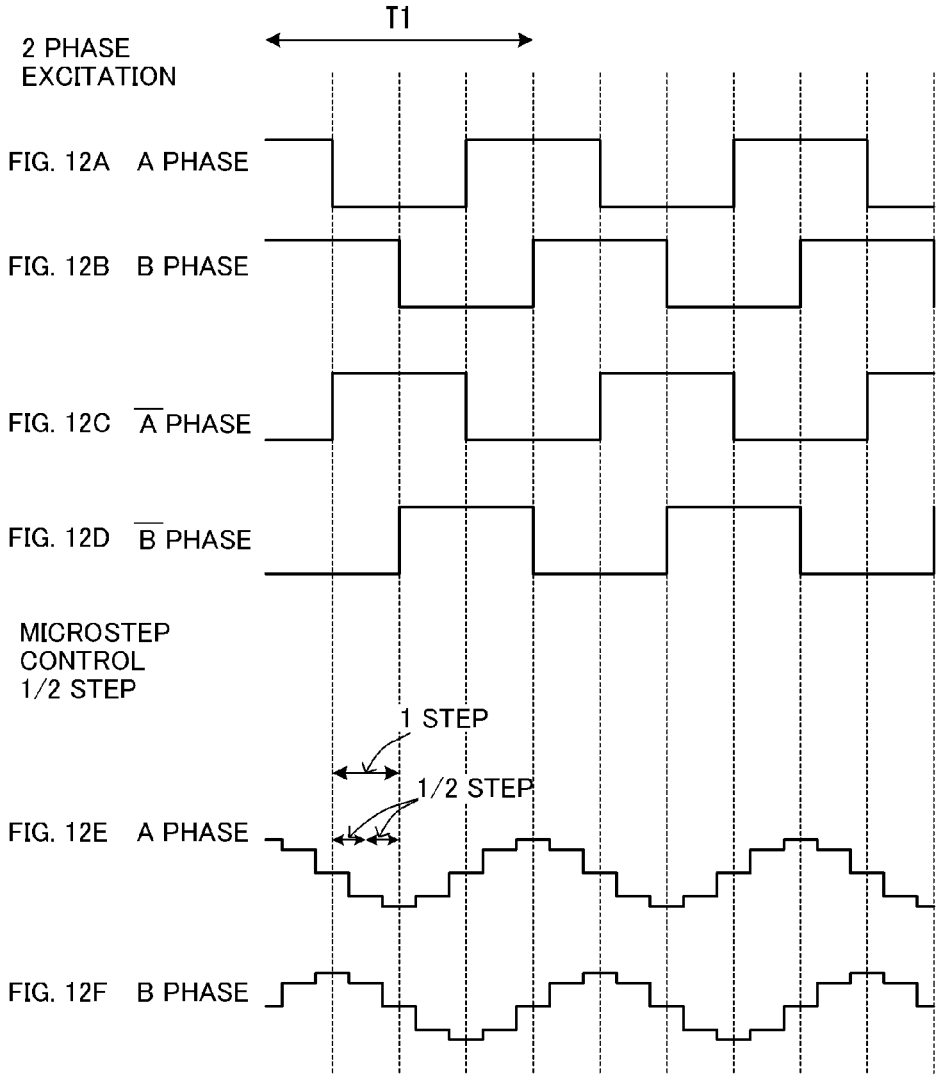
T1
2 PHASE
EXCITATION
FIG. 12A A PHASE
FIG. 12B B PHASE
FIG. 12C $\overline{A}$ PHASE
FIG. 12D $\overline{B}$ PHASE
MICROSTEP
CONTROL
1/2 STEP
1 STEP
1/2 STEP
FIG. 12E A PHASE
FIG. 12F B PHASE

FIG. 13A 1/2 STEP

FIG. 13C 1/4 STEP

FIG. 13E 1/8 STEP

FIG. 14A 2 PHASE EXCITATION
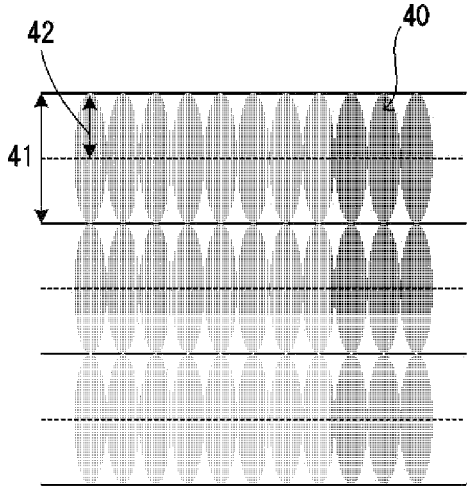
FIG. 14B 1/2 STEP CONTROL
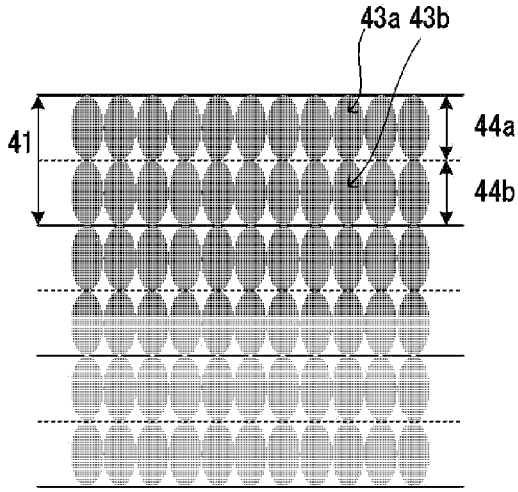
FIG. 14C 1/4 STEP CONTROL
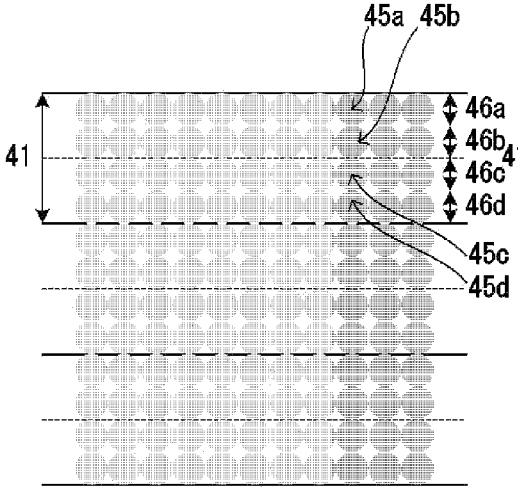
FIG. 14D 1/8 STEP CONTROL
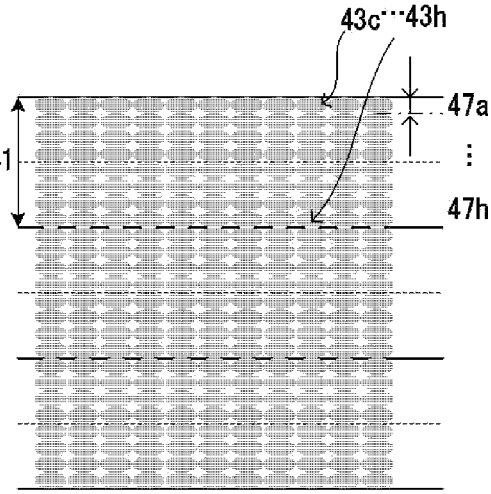

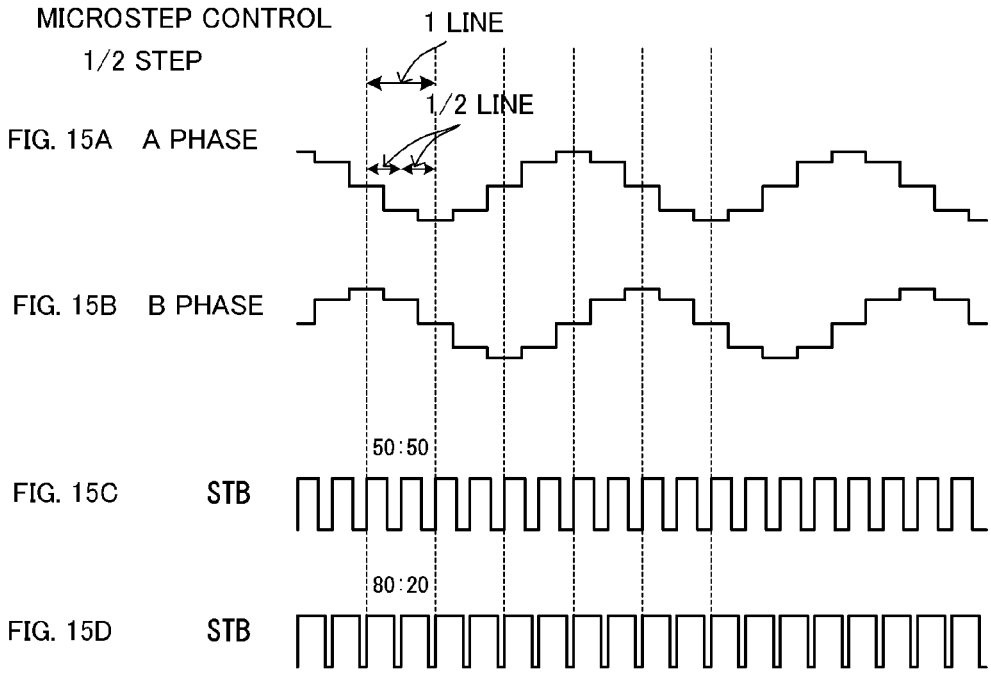
MICROSTEP CONTROL
1/2 STEP
1 LINE
1/2 LINE
FIG. 15A A PHASE
FIG. 15B B PHASE
50:50
FIG. 15C STB
80:20
FIG. 15D STB

MICROSTEP
CONTROL
1/4 STEP
1 LINE
1/4 LINE

A PHASE
80
20

STB
80
60
40
20

STB $Lf = vf \cdot t$ $Ls = vs \cdot t$ $Ls' = vs \cdot t'$

2 PHASE EXCITATION

THERMAL PRINTER

TECHNICAL FIELD

The present invention relates to a thermal printer, and more particularly, it relates to an energization control of a thermal head.

BACKGROUND ART

The thermal printer is a device for carrying out a print operation by driving multiple heating elements that constitute a thermal head in the form of a line. A maximum number of dots that can be driven simultaneously among all the heating elements arranged in the form of a line are subjected to a time-sharing drive.

A reason why such time-sharing drive is employed is as the following; if all the heating elements are driven simultaneously, power consumption is increased and the voltage applied on each of the heating elements is lowered. Lowering of the voltage that is applied on each of the heating elements may cause a deterioration of print density and uneven print quality.

In view of the problem above, the maximum number of dots that can be driven simultaneously is preset, and the heating elements arranged in one line is segmented and driven in units of some heating elements, the number of which corresponds to the maximum number of dots being preset as described above. By way of example, if the maximum number of dots that can be simultaneously driven is preset as 64 dots among the thermal head in which 256 dots of heating elements are arranged in one line, the one line is divided by four (4=256/64), and four times of driving are performed using 64 dots as a unit, so as to drive all of the dots within one line.

FIG. 18 illustrates the drive of the thermal head using the segmented blocks. Here, the thermal head 200 is made up of the heating elements 201 being connected with one another, the total number of which is N. If it is assumed that the number of the heating elements that is allowed to be energized simultaneously is n, under to the constraint of power supply capacity, the heating elements 201, the total number of which is N, are segmented into the blocks, each including n heating elements 201, according to the relationship between the total number N and the simultaneous-energization possible number n, and then, power feeding is performed for each of the segmented blocks. FIG. 18 illustrates the case where the number of the segmented blocks is assumed as eight.

FIG. 18A illustrates a drive state when the total number of dots to be energized in one line is less than the simultaneous-energization possible number n. If the number of dots to be energized is small, it is possible to energize one line at one time, thereby shortening a print cycle and raising a print speed. FIG. 18B illustrates a drive state when the total number of dots to be energized in one line is more than the simultaneous-energization possible number n. If the number of dots to be energized is large, it is not possible to energize one line at one time due to the constraint of the power supply capacity, and therefore, the energization is performed for each of the segmented blocks. Accordingly, the print cycle becomes longer and the print speed is lowered.

A larger maximum number of dots possible for the simultaneous drive may achieve a higher print speed. However, as described above, if the number of dots of the heating elements that are simultaneously driven is increased, the voltage drop may be enlarged by that much, an output voltage of the power supply becomes equal to or lower than a voltage level that guarantees proper operation, and a proper print operation is not guaranteed.

The voltage drop depends on inner electrical resistance of the power supply, resistance of the head, resistance of the other parts, and the like, and those resistance values are variable depending on production tolerance and electrical property. Therefore, conventionally, the factors above are considered, and the maximum number of dots possible for the simultaneous drive is preset assuming that the voltage of the power outlet terminal is under the worst condition being anticipated.

The heating elements within one line are segmented into blocks and energization is performed in units of the segmented block, whereby it is possible to resolve the constraints of power supply capacity. However, there is a problem that the configuration above may result in proportionately lowered print speed. As a method for resolving such lowering of the print speed, it is known that the cycle is set to be variable according to the number of segmented blocks.

However, it has been pointed out that if the speed is set to be variable, a printed dot length is also made variable, thereby causing another problem that a difference occurs in the length of printing.

FIG. 19A and FIG. 19B illustrate fluctuations of the print length, due to the variable print speed. In FIG. 19B, the dot length is represented by the product (v·t) of a speed v for transporting a print sheet and a pulse width t for feeding power into the heating element. A difference in the transport speed may cause a difference between the dot length Lf (=vf·t) when the print sheet is transported at a high transport speed vf, and the dot length Ls (vs·t) when the print sheet is transported at a low transport speed vs. As shown in FIG. 19B, this difference in the dot length L appears in the form of gap d between the lines.

In order to solve the problem above, there is suggested a drive method in which the print speed is made variable according to the division number when segmented into blocks, as well as the energization pulse width for energizing the heating element is made variable according to the print speed (see Patent document 1).

FIG. 19C and FIG. 19D illustrate the drive method in which the energization pulse width for energizing the heating element is made variable according to the print speed. Here, the energization pulse width is assumed as t when the print speed is high, and when the print speed is low, the energization pulse width is assumed as t', which is set to be longer than t. By setting the energization pulse width to be variable, the dot length Ls in the case of the low transport speed vs is adjusted to vs·t', which agrees with the dot length Lf in the case of the high transport speed vf, thereby resolving the difference in dot length L that is caused by the speed difference.

Patent document 1: Japanese Examined Patent Application Publication No. 8-25291

Patent document 2: Japanese Unexamined Patent Application Publication No. 6-191080

DISCLOSURE OF THE INVENTION

Problems to be Solved by the Invention

As described above, the print speed is made variable according to the division number of the segmented blocks, and further the energization pulse width for energizing the heating element is made variable according to the print speed, whereby speeding-up of the print speed and reducing the fluctuations in dot length are achieved, when the thermal head is driven by using the segmented blocks. However, if the division number of the segmented blocks is large and the print speed is low, an effect as expected may not necessarily be produced, due to properties or the like of the drive motor.

FIG. 20 illustrates a printing state during a slow rotation. In many cases, for example, a stepping motor is employed as a carrier motor for transporting the print sheet. This stepping motor is driven by excitation control, referred to as 2 phase excitation, in which the excitation states of two phases, A-phase and B-phase, are switched to drive a rotor (FIG. 20A).

In a printer, the head driving and paper feeding are performed by repeating energization to the head and switching the phases of the stepping motor. The rotor starts rotating at the time of phase-switching, and rotates toward a rotational position that is determined by the phase state after the switching, at a speed depending on a torque of a drive coil, inertia of the rotor, and the like, and then, one-turning action is completed. In the switched phase state, the rotor further performs a similar turning action upon receipt of a command for the next switching, and by repeating such actions, continuous rotation is performed. Therefore, a mean rotation speed of the rotor is determined depending on the phase switching cycle, resulting in that the rotation speed in each phase state becomes variable.

In the turning action of the stepping motor, at the time of high-speed rotation, fluctuations in rotation speed between the phase states are small, and accordingly, there are little gaps appearing between dots. Therefore, the head energization time is made variable according to the print speed as described above, and the occurrence of the gaps between the dots can be effectively suppressed (FIG. 20B).

On the other hand, when the stepping motor rotates at a low speed, fluctuations in rotation speed occurring between the phase states becomes larger, and there occurs a temporary halted state. Therefore, if printing is performed during the low-speed rotation, energization of the head is performed in the state where the stepping motor is temporarily halted, and printing for one dot is performed. During the time from when the energization is finished until when a command for the next phase switching is received, the printing is not performed. When the command for the next phase switching is received, the rotor starts rotating toward the rotational position determined by the phase state after the switching, and energization is performed at this rotational position to print the next dot.

Therefore, even though the energization time for the head is set to be variable according to the print speed, the print sheet is in a state of temporary suspension during the low speed rotation. Therefore, the change of the energization time is just changing the energization time at the halting position, leaving an unresolved problem that a gap occurs between the dots (FIG. 20C).

An object of the present invention is to solve such conventional problems as described above, and in the present invention, when printing is performed by a thermal printer head using segmented blocks, the printing can be performed without causing a gap between dots, even though the division number for the segmented blocks is large and the printing speed is low.

Means to Solve the Problems

The thermal printer according to the present invention is characterized in the following: when printing is performed by using a thermal printer head segmented into blocks, the number of dots printed in one line varies between the case where a division number for the segmented blocks is small and a printing speed is high, and the case where the division number for the segmented blocks is large and the printing speed is low; and in the case where the division number for the segmented blocks is large and the printing is performed at a low speed, paper feeding within one line is performed using multiple pitches so as to prevent the paper from being halted within the one line, and the number of dots printed on one line is increased by energizing each of the pitches, thereby preventing generation of gaps between dots and between lines.

Furthermore, a ratio of power feeding amount for energizing each of the pitches is varied in the multiple pitches within one line, whereby a difference in density among the pitches within one line is reduced.

The thermal printer according to the present invention is provided with: a thermal head including multiple heating elements being connected with one another in the form of a line and allowed to be energized simultaneously, which are segmented into one or multiple blocks, the heating elements being enabled to be driven by the energization in units of the segmented blocks that are obtained by dividing, and printing of one line being performed according to an energization cycle for the segmented blocks; a paper carrier for feeding paper to the thermal head; a power feeding section for feeding power into the heating elements of the thermal head with respect to each of the segmented blocks, and a controller for controlling the paper carrier and the power feeding section.

The control of the paper carrier according to the controller varies a paper feeding pitch within one line, with respect to each of the lines, based on the division number of the segmented blocks. The number of dots to be printed in one line is altered so as to change the pitch, between the case where the division number of the segmented blocks is small and high-speed printing is performed, and the case where the division number of the blocks is large and low-speed printing is performed. Under this control, if the printing is performed at a low speed when the division number of the segmented blocks is large, paper feeding within one line is performed in multiple pitches, thereby preventing a situation where the paper sheet is halted within one line. The controller forms multiple dots in the paper feeding direction within one line, in such a manner that the number of dots positively correlates with the division number corresponding to the number of the multiple blocks being segmented.

The control of the power feeding section according to the controller performs power feeding with respect to each paper feeding pitch within one line. By energizing each of the paper feeding pitches and increasing the number of dots printed in one line, it is possible to prevent generation of gaps between dots and between lines. The power feeding section feeds power into each of the dot pitches within one line, and sets the energization amount for a former dot pitch to be equal to or larger than the energization amount for a latter dot pitch.

In the present invention, the variations of pitch within one line is performed based on the division number of the segmented blocks, by comparing a preset value of a certain division number with the division number when printing of the line is performed. The preset division number used for switching to change the pitch may be defined according to characteristics of the thermal printer, such as a property of the heating elements of the thermal head and a power supply capacity, properties of the descriptions to be printed, for example, the printing object is a character or an image, and environmental conditions such as temperature condition when the thermal printer is used.

The thermal printer according to one aspect of the present invention may be implemented, employing a stepping motor as a drive motor for transporting a paper sheet. In this aspect of the invention, the paper carrier is provided with the stepping motor, and the drive of the stepping motor is controlled by a motor controller that is provided in the controller of the thermal printer.

The motor controller compares the division number of the segmented blocks with the preset value, and when the division number is smaller than the preset value, the motor controller drives the stepping motor in a 2 phase excitation mode to feed paper for one line in one dot pitch, and performs printing by feeding power required for one dot pitch as to each of the blocks in one line. On the other hand, when the division number is larger than the preset value, the motor controller divisionally drives the stepping motor to feed paper for one line in multiple dot pitches, and performs printing by feeding power more than once, required for the multiple dot pitches respectively, as to each of the blocks in one line.

For the divisional drive, it is possible to employ a divisional drive according to a 1-2 phase excitation mode, or a divisional drive according to a microstep drive. The motor controller is allowed to execute any of the following controls: paper feeding control for feeding paper in two times of dot pitch for one line, by the divisional drive according to the 1-2 phase excitation mode; paper feeding control for feeding paper in n times of dot pitch (n is positive integer) by the divisional drive according to the microstep drive; and paper feeding control using both the 1-2 phase excitation mode and the microstep drive.

In the 2 phase excitation mode, a drive for one revolution is established according to four excitation states including positive and negative states for two phases (A-phase and B-phase) each, and paper is transported by associating one excitation state with one dot pitch in one line. On the other hand, in the 1-2 phase excitation mode, a drive for one revolution is established according to eight excitation states including positive and negative states for two phases (A-phase and B-phase) each and one excitation state is associated with one dot pitch out of dot pitches appearing two times in one line, allowing the paper to be transported for one line in the two-time dot pitches respectively in two excitation states being continuous. It is to be noted here that if the division number of the segmented blocks agrees with the preset value, it is possible to determine optionally which excitation mode the excitation drive employs, the 2 phase excitation or the 1-2 phase excitation.

The microstep drive is a driving mode for driving a stepping motor, by dividing a basic step angle into smaller step angles. Driving in n times of 1/n step by dividing into smaller angles allows the paper to be transported in association with dot pitches of n times in one line. For example, the step angle is divided into ½ and the motor is driven in two times of ½ step, thereby transporting the paper for one line in association with two-time dot pitches. In this case, the feeding operation is similar to the feeding in the 1-2 phase excitation mode as described above. In the microstep drive, driving is generally performed by using an excitation current waveform being a sinusoidal form with a small torque ripple.

Accordingly, if the stepping motor is driven in the 2 phase excitation mode, only once excitation allows the paper to be transported by the width of one line, thereby establishing high-speed printing. On the other hand, when the stepping motor is driven by the divisional drive, multiple steps are required to transport the paper for the width of one line, and therefore, printing is performed at a low speed. For example, when the stepping motor is driven in the 1-2 phase excitation mode, two-time excitations allow the paper to be transported for the width of one line, whereby a low-speed printing is performed. When the stepping motor is driven in the microstep drive, the step angle is fragmented into smaller step angles, and the paper is transported for the width of one line by the obtained small step angles, whereby the printing is performed at a low speed.

The controller of the present invention allows a power feeding controller to control power feeding amount, which is fed into the power feeding section. The power feeding controller controls the power feeding amount which is fed into each of the paper feeding pitches within one line, based on the paper feeding speed, and as to each paper feeding pitch, the segmented blocks are energized and the heating elements are driven. In this energization, the power feeding amount to be fed can be determined for each of the paper feeding pitches in one line, whereby the print density can be controlled in units of pitch, and the density between the pitches and the density between the lines can be adjusted.

The power feeding controller is provided with an energization ratio setting circuit for setting a ratio of energization amount to be fed for each of the paper feeding pitches in one line. In the divisional drive, the energization ratio setting circuit sets the ratio of energization amount to be fed for each divisional drive, when the drive is performed divisionally, based on the paper feeding speed.

In the 1-2 phase excitation mode, the paper is transported using pitches of two times; the former step dot pitch and the latter step dot pitch. In the microstep drive, the paper is transported in multiple dot pitches of n times, 1/n step for each.

The energization ratio setting circuit according to the present invention sets the ratio of energization amount to be fed for each unit of driving in the divisional drive, based on the paper feeding speed, whereby the print density can be controlled in units of pitch, and the density between dots and the density between lines are adjusted.

For example, the divisional drive in the 1-2 phase excitation mode, the ratio between the energization amount being fed in the dot pitch of the former step and the energization amount being fed in the dot pitch of the latter step is set based on the paper feeding speed. Then, the energization amount for energizing the head in the dot pitch of the former step and the energization amount for energizing the head in the dot pitch of the latter step are determined.

It is to be noted the power feeding amount to be supplied to the head within one line, being the total of the energization amount in the former step pitch and the energization amount in the latter step pitch, is determined based on the division number of the segmented blocks. The energization ratio setting circuit sets the ratio for distributing the power feeding amount, which is supplied to the head within one line, into the former step pitch and the latter step pitch.

When one line is divided into two periods, the former step dot pitch and the latter step dot pitch, to perform dot printing in each of the periods, due to a hysteresis effect incorporated in the heating elements, the dot printing during the period of the latter step dot pitch is influenced by the heat generated from the dot printing during the period of the former step dot pitch, and there is a possibility that density between pitches becomes different, between the former step dot pitch and the latter step dot pitch.

The influence due to the hysteresis effect that the former step dot pitch period exerts on the latter step dot pitch period depends on the paper feeding speed, and it is more influenced as the speed becomes higher. According to the paper feeding speed, the energization ratio setting circuit of the present invention sets the energization ratio, in such a manner that the energization fed in the dot pitch of the former step falls within the range from 50% to 100%, along with the speed variation from lower to higher. The energization ratio is set to be higher in the former step, as the paper feeding speed becomes higher. According to the setting of the energization ratio, the energization amount during the latter step period is reduced, considering the hysteresis effect of the heating elements, which are heated during the former step pitch period, thereby reducing a difference in print density of dots, between the periods of the former step dot pitch and the latter step dot pitch.

The energization ratio may be set in stepwise manner within the range from 50% to 100%. There is also another way to set the energization ratio gradually.

The energization ratio can be set based on an energization time or an electric current value. When the energization ratio is set based on the energization time, the energization time for the latter step dot pitch is made shorter than the energization time for the former step dot pitch. Alternatively, when the energization ratio is set based on the electric current value, the current value for the latter step dot pitch is made smaller than the current value for the former step dot pitch.

In the divisional drive using the microstep drive, it is possible to reduce influences of uneven density due to the hysteresis effect, by setting the ratio of energization amount fed in each of the steps within one dot pitch according to the paper feeding speed.

In the divisional drive using the microstep drive, the energization ratio setting circuit sets the energization ratio to be fed in the first step in one dot pitch in stepwise manner within the range from 50% to 100%, according to the paper feeding speed. In addition, it is further possible to set the energization ratio to be fed in the first step in one dot pitch gradually in the range from 50% to 100%.

The energization ratio setting circuit is allowed to configure settings based on the energization time or a value of flowing current. In setting based on the energization time, the energization time from the second step is set to be shorter than the energization time of the first step. In setting based on the flowing current, the flowing current from the second step is set to be smaller than the flowing current in the first step.

It is to be noted here that the 2 phase excitation mode and the 1-2 phase excitation mode are well-known excitation modes to be employed for the stepping motor. Furthermore, the patent document 2 discloses a configuration of a thermal transfer printer in which the stepping motor is driven by a heat resistant mode using the 1-2 phase excitation, in addition to a normal 2 phase excitation mode. However, the heat resistant mode by the 1-2 phase excitation aims at enhancing tight-adherence when an ink ribbon having a high heat resistance is used, by doubling energy density to be applied to the thermal head. Therefore, an object of this conventional art is different from the present invention, which prevents occurrence of a gap between dot pitches, by switching the 2 phase excitation mode and the 1-2 phase excitation mode according to the division number of the segmented blocks.

Effect of the Invention

According to the thermal printer of the present invention, when printing is performed by segmenting the thermal head into blocks, it is possible to perform printing without generating a gap between dots, even though the division number of the segmented blocks is large and printing speed is low.

BRIEF DESCRIPTION OF DRAWINGS

FIGS. 2A to 2H illustrate a 2 phase excitation mode and a 1-2 phase excitation mode of a stepping motor;

FIGS. 3A and 3B illustrate dot pitches in one line;

FIGS. 5A and 5B illustrate a hysteresis effect on heating elements;

FIGS. 12A to 12F illustrate the microstep drive of the stepping motor;

FIGS. 13A to 13F illustrate the microstep drive of the stepping motor;

FIGS. 14A to 14D illustrate dot pitches in one line according to the microstep drive in the present invention;

FIGS. 15A to 15D illustrate a ratio of energization amount in ½ step of the microstep drive according to the present invention;

DENOTATION OF REFERENCE NUMERALS

1 THERMAL PRINTER
11 INTERFACE
12 DATA RECEIVING SECTION
13 RECEIVING BUFFER
14 PRINTING BUFFER
15 LATCH CIRCUIT
16 THERMAL HEAD
17 POWER FEEDING SECTION
18 PAPER CARRIER
18*a* CARRIER MOTOR
20 CONTROLLER
21 MAIN CONTROLLER
22 PRINT CONTROLLER
22*a* BLOCK SEGMENTATION PROCESSING CIRCUIT
22*b* SPEED SETTING CIRCUIT
23 MOTOR CONTROLLER
23*a* 2 PHASE EXCITATION CIRCUIT
23*b* 1-2 PHASE EXCITATION CIRCUIT
23*c* SELECTION CIRCUIT

30 DOT
31 ONE LINE
32 DOT PITCH
33*a*, 33*b* DOT
34*a*, 34*b* ONE DOT PITCH
40 DOT
41 ONE LINE
42 DOT PITCH
43*a*, 43*b* DOT
44*a*, 44*b* ONE DOT PITCH
45*a* TO 45*d* DOT
46*a* TO 46*d* ONE DOT PITCH
47*a* TO 47*h* DOT
48*a* TO 48*h* ONE DOT PITCH
100 CPU
101 ROM
102 RAM
103 DISPLAY DEVICE
104 INPUT DEVICE
105 POWER SUPPLY
106 THERMAL HEAD
107 POWER FEEDING SECTION
108 PAPER CARRIER
200 THERMAL HEAD
201 HEATING ELEMENT
202 BLOCK

BEST MODE FOR CARRYING OUT THE INVENTION

Hereinafter, the thermal printer according to the present invention will be explained in detail, with reference to the accompanying drawings. It is to be noted here that FIG. 1 to FIG. 9 are referred to for explaining an example using the 1-2 phase excitation mode, and FIG. 11 to FIG. 16 are referred to for explaining an example using the microstep drive. FIG. 10 is a block diagram for explaining a schematic configuration of the thermal printer according to the present invention. FIG. 17 is a schematic functional diagram when the 1-2 phase excitation mode and the microstep drive are combined.

Figure 1:
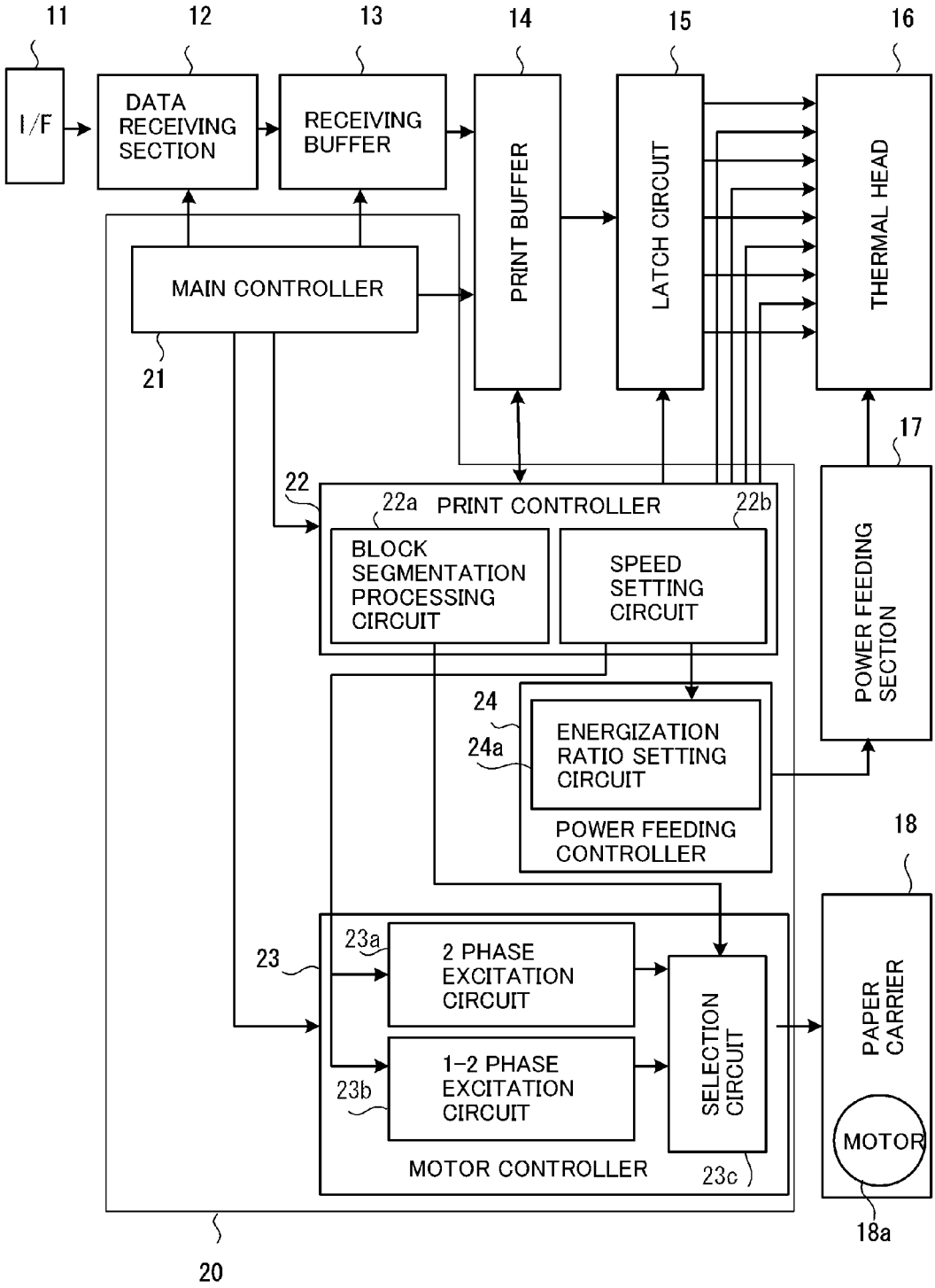
FIG. 1 is a diagram to explain schematic functions of a thermal printer according to the present invention.

Firstly, there will be explained an example for controlling the motor, using the 1-2 phase excitation mode. FIG. 1 is a diagram to explain schematic functions of the thermal printer according to the present invention, and this diagram illustrates an example using the 1-2 phase excitation mode.

A thermal printer 1 incorporates a thermal head 16 that is made up of multiple heating elements (not illustrated), which are arranged in the form of a line.

A controller 20 selectively drives some heating elements to be driven out of the multiple heating elements, based on print data that is inputted from an external device such as a host device. Accordingly, dots are formed on a print medium (thermosensitive paper) in association with the heating elements, respectively, whereby printing is performed. Connection with a power supply is turned ON or OFF every printing point of time at predetermined intervals, so that the drive of the heating elements is controlled.

The thermal printer 1 incorporates an interface 11 for establishing communication with an external device such as the host device, not illustrated, a data receiving section 12, a receiving buffer 13 for temporarily storing received data, a print buffer 14 for temporarily storing print data, a latch circuit 15 for storing print data corresponding to one line, the thermal head 16 for driving the heating elements to perform printing, a power feeding section 17 for feeding drive current to the heating elements of the thermal head 16, a paper carrier 18 for transporting paper (not illustrated), and the controller 20.

The controller 20 incorporates a main controller 21 for exercising controls all over the thermal printer, a print controller 22 for control printing, a motor controller 23 for controlling drive of a carrier motor 18*a* provided in the paper carrier 18, and a power feeding controller 24 for controlling the power feeding section 17.

The main controller 21 is provided with a print data analysis means (not illustrated) for analyzing the print data being inputted and forming a print pattern.

The print controller 22 is provided with a block segmentation processing circuit 22*a* for selecting heating elements to be driven simultaneously based on the print pattern being analyzed, so as to perform processing of setting a division number of segmented blocks. The print controller 22 is further provided with a speed setting circuit 22*b* for setting a speed to transport paper, based on the division number of the segmented blocks, the division number having been set in the block segmentation processing circuit 22*a*.

The motor controller 23 of the present invention is provided with a 2 phase excitation circuit 23*a* and a 1-2 phase excitation circuit 23*b*, as excitation circuits for supplying excitation current to a drive coil of the carrier motor 18*a*, and a selection circuit 23*c* for selecting either of the excitation circuits for driving. The 2 phase excitation circuit 23*a* is a circuit to generate a strove signal that drives a stepping motor in a 2 phase excitation mode. The 1-2 phase excitation circuit 23*b* is a circuit to generate a strove signal that drives the stepping motor in a 1-2 phase excitation mode.

FIG. 2 illustrates the 2 phase excitation mode and the 1-2 phase excitation mode of the stepping motor. FIG. 2A to FIG. 2D illustrate excitation signals of respective phases for explaining the 2 phase excitation mode. FIG. 2E to FIG. 2H illustrate excitation signals of respective phases for explaining the 1-2 phase excitation mode.

Drive of the stepping motor in the 2 phase excitation mode is performed in a mode that excites two phases (A-phase and B-phase) constantly, and even at the time of phase switching, one phase is always excited. On the other hand, drive of the stepping motor in the 1-2 phase excitation mode is performed in a mode that alternately performs an 1 phase excitation mode for constantly exciting only one phase, and the 2 phase excitation mode, and an angular displacement is made half, compared to the 1 phase excitation mode or the 2 phase excitation mode, whereas a driving frequency is approximately doubled.

In the case of the 2 phase excitation mode, the stepping motor makes one revolution by switching phases in four steps (cycle T1 in the figure). On the other hand, in the case of the 1-2 phase excitation mode, the stepping motor makes one revolution by switching phases in eight steps (cycle T2 in the figure).

FIG. 3 illustrates dot pitches in one line. FIG. 3A shows dot pitches in one line when the drive is performed in the 2 phase excitation mode. FIG. 3B shows dot pitches in one line when the drive is performed in the 1-2 phase excitation mode.

When the stepping motor is subjected to the 2 phase excitation and paper feeding is performed in this mode, as shown in FIG. 3A, the paper is fed for one line (a distance indicated by the reference number 31 in the figure) every time when the phases are switched. During this period, one-time energization is performed to the heating elements, and one dot 30 is printed. Therefore, in the case of the 2 phase excitation mode, one-time phase switching allows the paper to be fed for one dot pitch (a distance indicated by the reference number 32 in the figure).

On the other hand, when the stepping motor is subjected to the 1-2 phase excitation and paper feeding is performed in this mode, as shown in FIG. 3B, two-time phase switching is performed within one line (a distance indicated by the reference number 31 in the figure), so as to perform paper feeding for a half of line twice. The energization is performed to the heating elements for each of the two-time paper feeding periods, so that dots 33*a* and 33*b* are printed. Therefore, in the case of the 1-2 phase excitation mode, the phase switching in the former step allows the paper feeding in the dot pitch corresponding to a half of one line (a distance indicated by the reference number 34*a* in the figure), and the phase switching in the latter step allows the paper feeding in the dot pitch corresponding to a half of one line (a distance indicated by the reference number 34*b* in the figure). Then, according to the phase switching by the two steps, the paper feeding for one dot pitch is performed.

The selection circuit 23*c* selects either the 2 phase excitation circuit 23*a* or the 1-2 phase excitation circuit 23*b*, based on the division number of the segmented blocks, the division number being determined in the block segmentation processing circuit 22*a*. For example, a certain division number is set in advance as a threshold for the selection. The division number obtained in the block segmentation processing circuit 22*a* is compared with the preset value which is set in advance. Then, according to a result of the comparison, it is determined which excitation signal is selected, an excitation signal generated by the 2 phase excitation circuit 23*a* or an excitation signal generated by the 1-2 phase excitation circuit 23*b*.

The carrier motor 18*a* in the paper carrier 18 is driven by the excitation signal that is selected based on the divisional number, which is outputted from the motor controller 23.

When the division number is less than the preset value, the selection circuit 23*c* determines that the paper is transported at a high speed, and selects the 2 phase excitation circuit 23*a* so that the paper is fed for one line in one dot pitch. On the other hand, when the divisional number is larger than the preset value, the selection circuit 23*c* determines that the paper is transported at a low speed, and selects the 1-2 phase excitation circuit 23*b* so that the paper is fed for one line in two times of dot pitch.

Figures 4A, 4B, 4C, 4D, 4E, 4F:
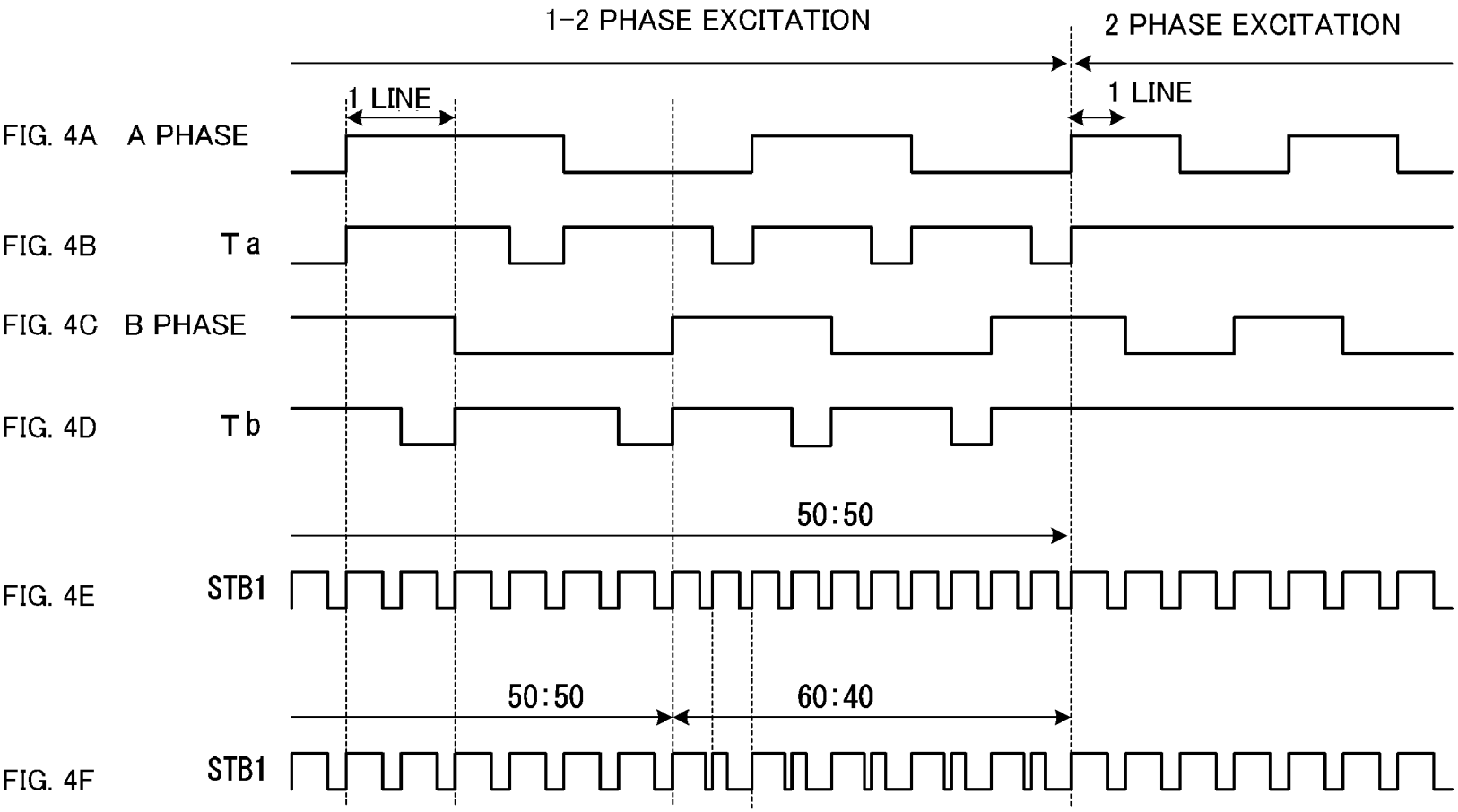
FIGS. 4A to 4F illustrate the 2 phase excitation mode and the 1-2 phase excitation mode.

FIG. 4 illustrates the 2 phase excitation mode and the 1-2 phase excitation mode. FIG. 4A and FIG. 4C respectively represent motor phases, A-phase and B-phase. The 2 phase excitation mode drives the motor by a combination of four-phase states of the two phases, A-phase and B-phase.

FIG. 4B and FIG. 4D represent control signals in the 1-2 phase excitation mode. The 1-2 phase excitation mode drives the motor by combining eight-phase states made up of the A-phase, the B-phase, and the control signals of the 1-2 phase excitation mode. It is to be noted here that FIG. 4 does not illustrate reversed phases.

In FIG. 4, in any of the phase excitation modes, 2 phase excitation and 1-2 phase excitation, one phase state corresponds to one dot. According to one pulse signal of the strove signal STB1, as shown in FIG. 4E and FIG. 4F, energization for one dot is performed, thereby printing one dot.

In the 2 phase excitation mode, one phase state among the combinations of four phase states corresponds to one-line paper feeding, and one pulse signal of the strove signal STB1 is applied within one line, thereby printing one dot pitch.

On the other hand, in the 1-2 phase excitation mode, continuous two phase states among the combinations of eight phase states correspond to paper feeding of one line. Two pulse signals of the strove signal STB1 are applied within one line, and printing dot pitches is performed in the respective phase states, whereby in total, two times of dot pitch printing establish printing for one line.

Switching of excitation between the 1-2 phase excitation mode and the 2-phase excitation mode is performed based on the division number obtained from the block segmentation processing circuit 22*a*. As shown in FIG. 4, switching of excitation from the 1-2 phase excitation mode to the 2 phase excitation mode is performed at the point of time when the divisional number becomes less than the preset value and high-speed paper feeding is required. In addition, though not illustrated in FIG. 4, in the case where the division number obtained in the block segmentation processing circuit goes over the preset value and low-speed paper feeding is required, switching of excitation from the 2 phase excitation mode to the 1-2 phase excitation mode is performed at that point of time.

FIG. 1 illustrates a configuration that excitation signals are generated in the 2 phase excitation circuit 23*a* and the 1-2 phase excitation circuit 23*b*, and the selection circuit 23*c* selects the excitation signals. However, it is further possible to configure such that a selection signal from the selection circuit 23*c* allows driving according to either of the excitation circuits, the 2 phase excitation circuit 23*a* and the 1-2 phase excitation circuit 23*b*.

In the case where the stepping motor is employed as the carrier motor 18*a*, the motor controller as described above switches between one-time paper feeding for one line, using one dot pitch, and two-time paper feeding for one line, using two times of dot pitch, by selecting the 2 phase control or the 1-2 phase control. However, the paper feeding control is not limited to this example. For instance, there is also another aspect of the drive control, or selection of at least three-time paper feeding for one line is also possible, by using a microstep drive, a carrier motor having a stator pole with three phases, or the like. It is to be noted that the microstep drive will be explained below, with reference to FIG. 12 to FIG. 16.

The power feeding controller 24 sets an energization time or a current value used for energizing the heating elements of the dots being selected, and controls the power feeding section 17 which controls the energization of one line of the heating elements of the thermal head 16. In the energization of each of the lines, the energization time for supplying drive current to the heating elements can be determined based on the power supply capacity, the division number of the segmented blocks, properties of the heating elements, and the like.

The power feeding controller 24 is provided with an energization ratio setting circuit 24*a* for setting an energization ratio, as to the amount of energization applied to the heating elements in each paper feeding, in the case where the motor controller 23 as described above performs the transporting in two times of dot pitch and performs two-time paper feeding for one line, according to the 1-2 phase control.

The energization ratio setting circuit 24*a* does not define the energization amount fed to the heating elements within one line, but it is to define a ratio between the amount of energization supplied at the time of the former dot pitch, and the amount of energization supplied at the time of the latter dot pitch, when the paper is transported for one line by two-time paper feeding in the 1-2 phase excitation mode. The ratio between the amount of energization fed at the time of the former step dot pitch, and the amount of energization fed at the time the latter step dot pitch is set according to the paper feeding speed.

The energization ratio fed at the time of former dot pitch is set according to the paper feeding speed, and in the former step pitch period, the energization ratio is set to be higher as the paper feeding speed becomes higher, in the range from 50% to 100% according to the speed variation from lower to higher. On the other hand, the energization ratio fed at the time of latter dot pitch is set to be lower as the paper feeding speed becomes higher, in the range of 50% to 0% according to the speed variation from lower to higher. It is to be noted here that the energization ratio during the period of the former step pitch and during the period of the latter step pitch are set in such a manner that the sum total of the ratio becomes 100%, for instance. However, an exothermic efficiency may be deteriorated due to the divisional energization, and considering such a case, the sum total of the energization ratio of the former pitch period and the latter pitch period may be set to 100% or higher.

Followings are reasons why the energization ratio of each pitch period is changed, between the former step and the latter step in the 1-2 phase controlling.

Density of the dots printed during the latter step pitch is influenced by the heated state of the heating elements, due to the energization during the former step pitch. Such influence of the energization state during the period of the former step pitch, exerted on the printing during the period of the latter step pitch is referred to as "hysteresis effect". When the state heated by the energization during the former pitch period still remains in the period of energization in the latter step, a temperature becomes equal to or higher than a temperature which is obtained when heated by the energization during the period of the latter step pitch only. Therefore, there occurs a difference in print density, between the dots printed during each of the pitch periods, the former step and the latter step. Such difference in the dot print density may appear on a printed image, in the form of uneven density in the line direction, for instance. This influence due to the hysteresis effect depends on the paper feeding speed, showing more significant impact, as the feeding speed becomes higher.

Figures 6A, 6B, 6C, 6D, 6E, 6F:
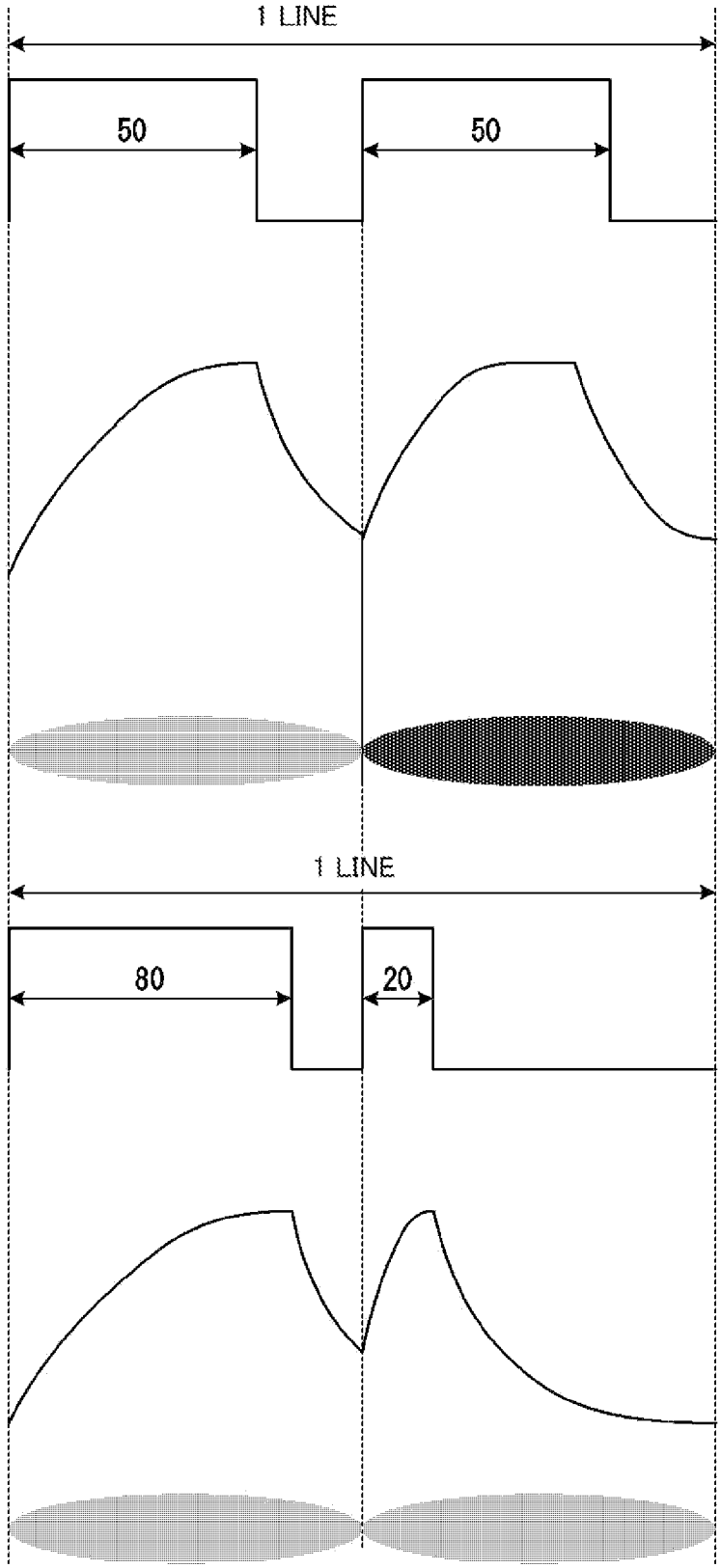
FIGS. 6A to 6F illustrate the hysteresis effect on the heating elements.

FIG. 5 and FIG. 6 illustrate the hysteresis effect. FIG. 5 schematically illustrates a printed example of dots when driving is performed in the 1-2 phase excitation mode at a low-speed paper feeding. FIG. 6 schematically illustrates that driving is performed similarly in the 1-2 phase excitation mode at a low-speed paper feeding, showing the energization ratio between in the former step pitch period and in the latter step pitch period within one line and a state of printing dots. Here, it is to be noted FIG. 5A, FIG. 6A to FIG. 6C illustrate the case where the energization ratio of the former step pitch period to that of the latter step pitch period are set to 50:50, and FIG. 5B, FIG. 6D to FIG. 6F illustrate the case where these energization ratio is set to 80:20.

When the energization ratio is 50:50 as shown in FIG. 5A, and FIG. 6A to FIG. 6C, due to the hysteresis effect from the former step pitch period on the latter step pitch period, a difference occurs in print density of the dot pitch, between the former step and the latter step within one line.

FIG. 6A illustrates a ratio of the energization to the heating elements, and FIG. 6B schematically illustrates a temperature condition of the heating elements which are heated by the energization. The temperature condition of the latter step pitch period maintains a higher temperature than the former step, because of the influence from the temperature condition of the former step pitch period. Therefore, as shown in the print state of the dots in FIG. 6C, there occurs a difference in dot pitch print density between the former step and the latter step within one line.

The energization ratio setting circuit 24*a* according to the present invention considers in setting the energization ratio, the hysteresis effect of the heating elements that were heated during the former step pitch period, and lowers the ratio of the energization performed in the latter step pitch period, so as to reduce the difference in the dot print density between the period of the former step pitch and the period of the latter step pitch.

FIG. 5B shows the case where the energization ratio is 80:20, and FIG. 6E schematically illustrates a temperature condition of the heating elements that are heated by the energization. By lowering the energization ratio of the latter step pitch period, as shown in FIG. 6F, the hysteresis effect from the former step pitch period on the latter step pitch period is lessened, thereby reducing the difference in the print density between the former step dot pitch and the latter step dot pitch in one line.

The energization ratio setting circuit according to the present invention is able to set the ratio of the energization for the dot pitches between in the former step and in the latter step, in a stepwise manner or gradually, within the range from 50:50 to 100:0 according to the speed variation from a low speed to a high speed. It is to be noted that the paper feeding speed can be obtained from the speed setting circuit 22*b* of the print controller 22.

Figures 7A, 7B, 7C, 7D:
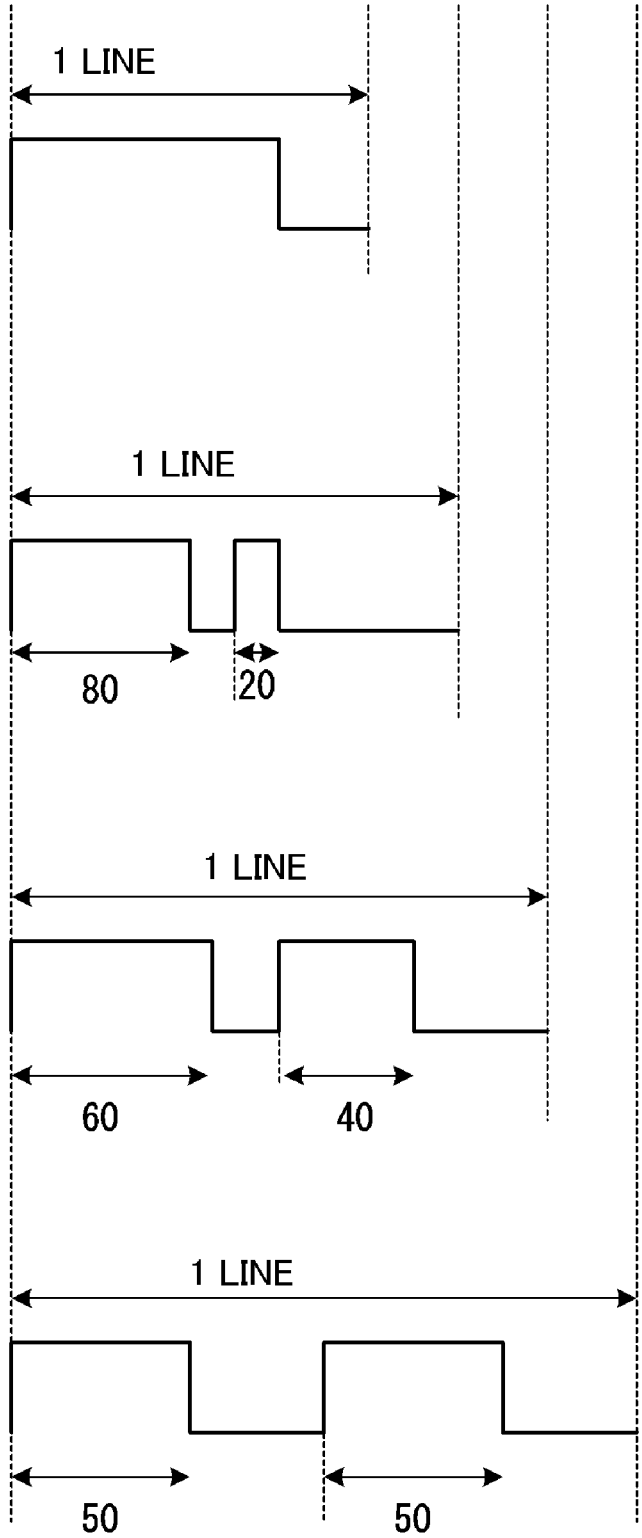
FIGS. 7A to 7D illustrate examples of setting an energization ratio in stepwise manner according to the present invention.

FIG. 7 illustrates an example for setting the energization ratio in stepwise. FIG. 7A shows a pulse signal of the energization within one line in the 2 phase excitation mode. FIGS. 7B to 7D show pulse signals of the respective energization ratios in the 1-2 phase excitation mode.

FIG. 7A illustrates the 2 phase excitation mode in which the division number of the segmented blocks is small and paper feeding is performed at a high speed. Since the paper feeding is performed at a high speed, duration of the energization period corresponding to one line is set to be the shortest. On the other hand, FIG. 78 to FIG. 7D illustrate the 1-2 phase excitation mode in which the division number of the segmented blocks becomes larger and the paper feeding is performed at a lower speed than the case of FIG. 7A. Since the paper feeding is performed at a low speed, the duration of the energization period corresponding to one line is set to be longer in proportion to the division number. It is to be noted that the speed setting circuit 22*b* sets the aforementioned duration of the energization period corresponding to one line.

In the 1-2 phase excitation mode, the energization ratio between the former step pitch period and the latter step pitch period is determined according to the paper feeding speed. FIG. 7B illustrates a case where the speed is relatively high, similar to the 2 phase excitation mode, among the three examples in the 1-2 phase excitation mode. In this case, since pausing between the energization for the former step pitch period and the energization for the latter step pitch period is short, the energization ratio is set to be 80:20.

FIG. 7D illustrates a case where the speed is the lowest among three low speed examples in the 1-2 phase excitation mode. In this case, since pausing between the energization for the former step pitch period and the energization for the latter step pitch period is long, the energization ratio is set to be 50:50.

FIG. 7C illustrates a case where the speed is in the middle of the three low speed examples performed in the 1-2 phase excitation mode. In this case, the energization ratio is set to be 60:40, between the aforementioned 80:20 and 50:50.

Settings of the energization ratio can be configured by using an energization time or a current value. In the examples shown in FIG. 7, the energization ratio is set using the energization time, and the energization time in the latter step dot pitch is set to be shorter than the energization time in the former step dot pitch. If the energization ratio is set using the current value, the current value in the latter step dot pitch is set to be smaller than the current value in the former step dot pitch.

In the examples discussed above, the energization ratio is set in a stepwise manner. However, it is possible to set the ratio gradually in a continuous manner.

Next, with reference to the flowchart of FIG. 8, there will be explained a procedure for setting the paper feeding speed by switching the excitation modes and setting the energization ratio in the printer according to the present invention. It is to be noted that processing after the block segmentation process will be explained here.

Firstly, in the block segmentation process, the division number of the segmented blocks is set as to a line to be printed (S1). A preset value of the division number is defined in advance, based on which switching is performed, determining whether the stepping motor is driven in the 2 phase excitation or the stepping motor is driven in the 1-2 phase excitation. Using this preset value as a threshold, and judgment is made as to the division number obtained in the block segmentation process (S2).

In the comparison step in S2, if the division number is smaller than the preset value, it is determined high-speed paper feeding is performed, and the 2 phase excitation mode is set (S3). On the other hand, in the comparison step S2, if the division number is the preset value or larger, it is determined that low-speed or middle-speed paper feeding is performed, and the 1-2 phase excitation mode is set (S4). When the 1-2 phase excitation mode is set, a paper feeding speed is obtained from the speed setting circuit 22*b*, and an energization ratio in association with this speed is set.

Figure 9:
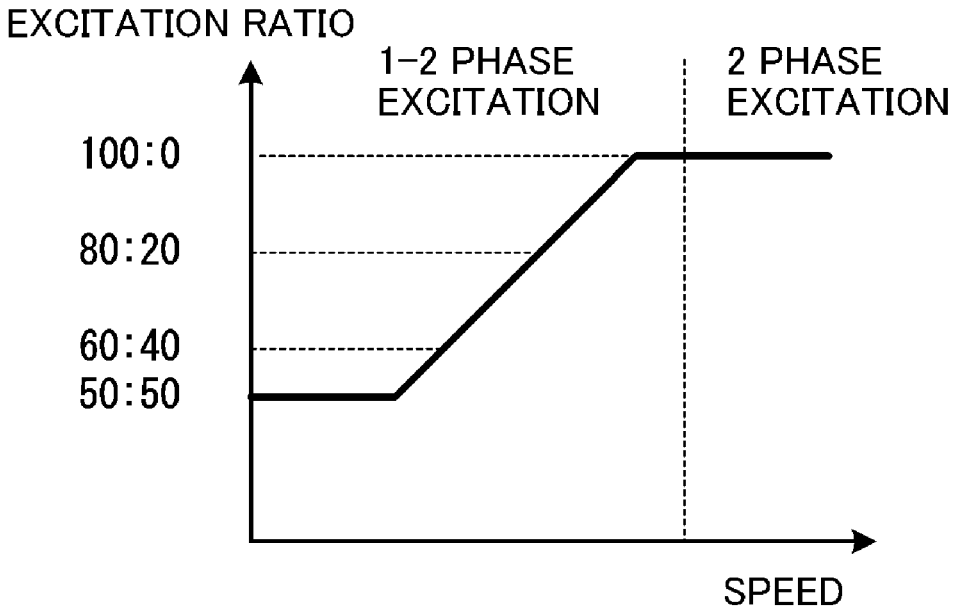
FIG. 9 illustrates setting of the energization ratio of the printer according to the present invention.
Figure 10:
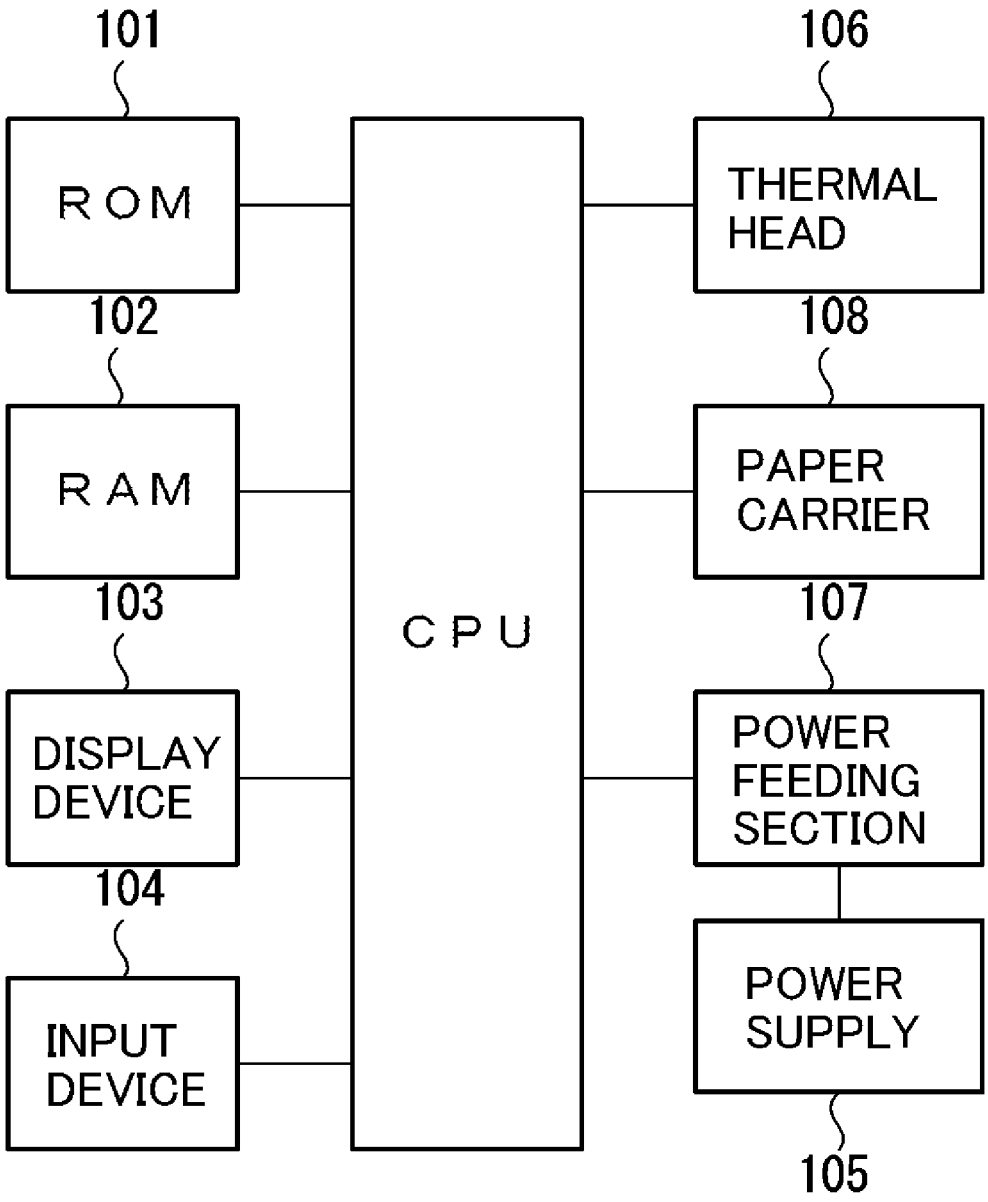
FIG. 10 is a block diagram to explain a schematic configuration of the thermal printer according to the present invention.

FIG. 9 illustrates setting of the energization ratio. The energization ratio can be determined by the excitation state and the speed of the stepping motor, and FIG. 9 shows the state how the setting is performed.

In FIG. 9, when the speed is high, the stepping motor is driven in the 2 phase excitation mode. Since the 2 phase excitation mode does not include the latter step pitch period, the energization ratio in this case corresponds to 100:0.

When the speed is low, the stepping motor is driven in the 1-2 phase excitation mode. In the 1-2 phase excitation mode, the energization ratio is set in such a manner that the ratio of the former pitch period becomes higher in sequence within a range of 50:50 to 100:0, according to the speed variation from a low speed to a high speed (S5). The steps of S1 to S5 described above are repeated with respect to each line (S6).

FIG. 10 is a block diagram for explaining a schematic configuration of the thermal printer according to the present invention. In FIG. 10, The thermal printer incorporates a CPU 100, an ROM 101, an RAM 102, a display device 103, an input device 104, a power supply 105, a thermal head 106, a power feeding section 107, and a paper carriage 108, and the CPU is connected to the other elements.

The CPU 100 exercises controls all over the thermal printer, according to an operating system and various application software stored in the ROM 101. The ROM 101 further stores database and character fonts therein. The RAM 102 stores primary data in computation, and further stores programs and data transmitted from other devices.

The display device 103 and the input device 104 are I/O peripheral devices, and any display device such as a liquid crystal display, a CRT, and a plasma display may be employed as the display device. The input device 104 may be a keyboard, a pointing device, or the like, to input character string data and various commands.

The thermal head 105 configures the line printer by arranging multiple heating elements in the form of a line. The CPU 100 is provided with each of the aforementioned functions shown in FIG. 1 and exercises time-sharing control over the energization to the heating elements of the thermal head 105, in accordance with the number of simultaneous drive dots.

In addition, the power feeding section 107 is connected to the power supply 105, so as to feed power into the controller and each of the elements provided in the printer, and power is also fed into the paper carrier 108 which incorporates the carriage motor, and the like.

Figure 11:
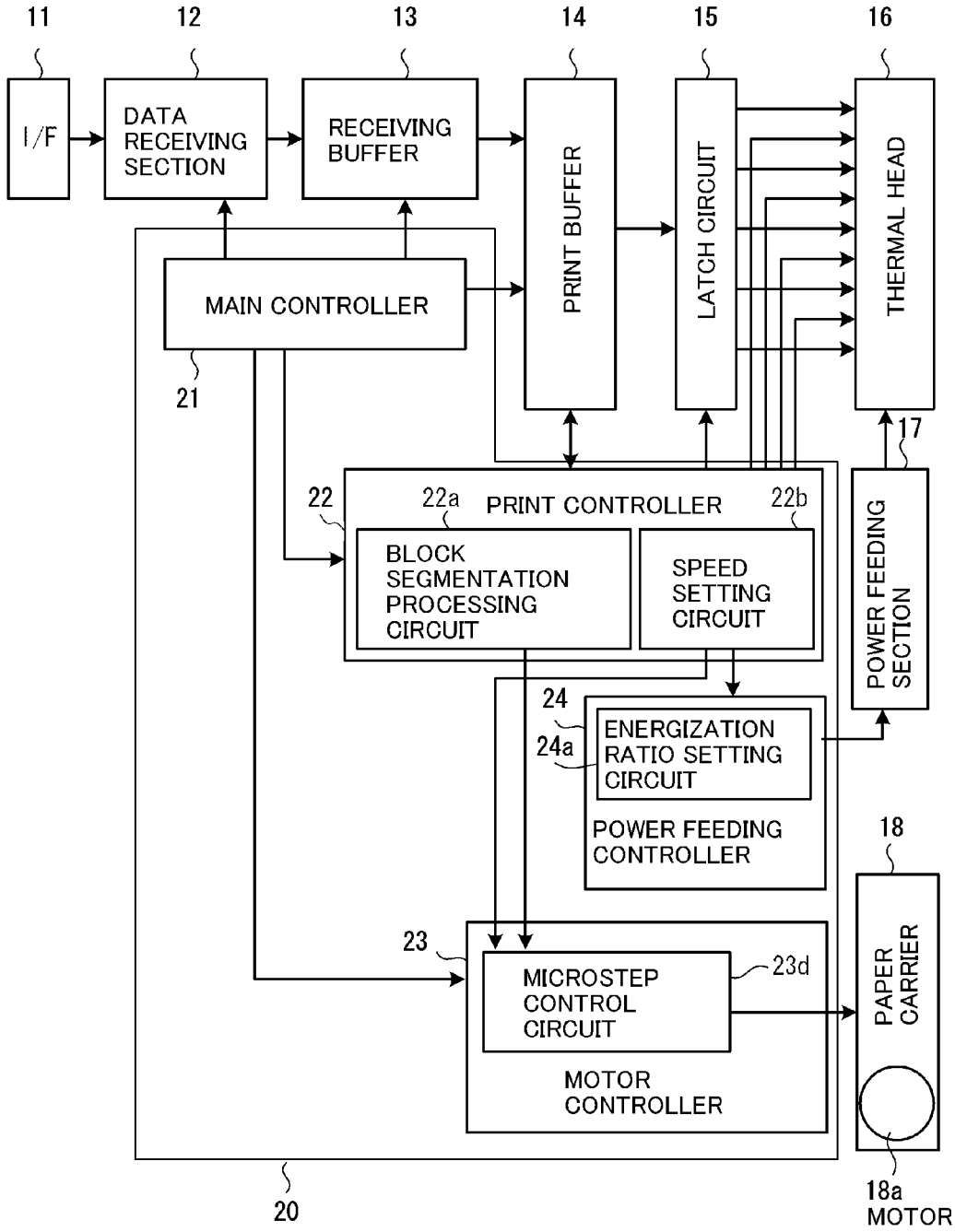
FIG. 11 is a diagram to explain schematic functions of the thermal printer according to the present invention, explaining an example using a microstep drive.

Next, an example for controlling the motor using the microstep drive will be explained. FIG. 11 is a diagram to explain schematic functions of the thermal printer according to the present invention, explaining an example using the microstep drive.

The configuration as shown in FIG. 11 is almost the same as that of the thermal printer 1 as shown in FIG. 1, but the configuration of the motor controller 23 is different. Hereinafter, only the configuration of the motor controller 23 will be explained. Since the other elements other than the motor controller are the same as those illustrated in FIG. 1, tedious explanation will not be made here.

The motor controller 23 according to the present invention is provided with a microstep control circuit 23*d*, as an excitation circuit for supplying the drive coil of the carrier motor 18*a* with excitation current, instead of the 2 phase excitation circuit 23*a*, the 1-2 phase excitation circuit 23*b*, and the selection circuit 23*c*, which are configuration for the 1-2 phase excitation mode as shown in FIG. 1. The microstep control circuit 23*d* divides a step angle, and generates a signal to drive the motor by the small step angles obtained by the division. This microstep control circuit 23*d* compares the division number obtained from the block segmentation processing circuit 22*a* with the preset value, and sets a paper feeding pitch for one line, based on the comparison result. If the division number is smaller than the preset value, one line is driven by one dot pitch, establishing a high-speed drive, whereas if the division number is larger than the preset value, the step is segmented by the microstep drive, so as to drive one line by multiple pitches, establishing a low-speed drive. It is further possible to provide multiple preset values, and the step number of the microstep drive may be determined according to the division number. If the division number is large, the step number to be set is increased to establish much lower speed. It is to be noted that the stepping motor may be in either the 2 phase excitation mode or the 1-2 phase excitation mode. Here, the case of employing the 2 phase excitation mode will be explained.

FIG. 12 and FIG. 13 illustrate the microstep drive of the stepping motor. FIG. 12A to FIG. 12D show the excitation signals of the respective phases for explaining the 2 phase excitation, and FIG. 12E and FIG. 12F show the excitation signals of A-phase and B-phase respectively for explaining the microstep drive. In the examples here, the microstep drive is performed in ½ step.

In the microstep drive in ½ step, one step corresponding to one phase in the 2 phase excitation mode is divided into two steps, and one revolution is made by eight ½ steps. Accordingly, the drive frequency using ½ step is approximately doubled.

Figures 13B, 13D, 13F:
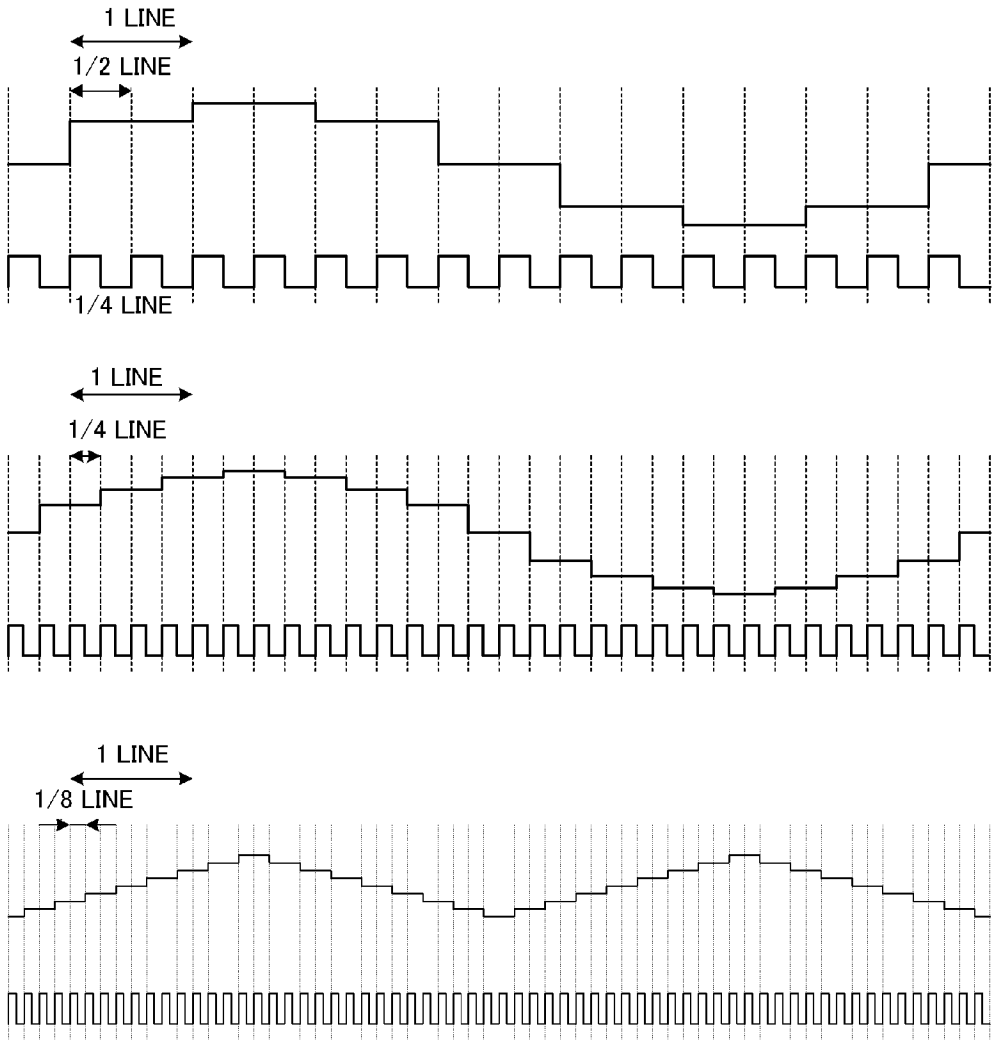

FIG. 13A and FIG. 13B respectively illustrate excitation signals according to the microstep drive in ½ step and power feeding signals directed to the head. FIG. 13C and FIG. 13D respectively illustrate the excitation signals according to the microstep drive in ¼ step and the power feeding signals directed to the head. FIG. 13E and FIG. 13F respectively illustrate the excitation signals according to the microstep drive in ⅛ step and the power feeding signals directed to the head.

In FIG. 13C, one step corresponding to one phase in the 2 phase excitation mode is divided into four segmented steps in the microstep drive using ¼ step, and one revolution is made by sixteen ¼ steps. Accordingly, the drive frequency using ¼ step becomes approximately four times larger. In FIG. 13E, one step corresponding to one phase in the 2 phase excitation mode is divided into eight segmented steps in the microstep drive using ⅛ step, and one revolution is made by thirty-two ⅛ steps. Accordingly, the drive frequency using ⅛ step becomes approximately sixteen times larger.

In each of the segmented steps, obtained by the division, the head is fed with power by the power feeding signals as shown in FIG. 13B, FIG. 13D, and FIG. 13F, respectively.

It is to be noted here that the microstep drive has a waveform of normal excitation current, being a sinusoidal form, and thereby torque ripple is reduced.

FIG. 14 illustrates dot pitches in one line according to the microstep drive. FIG. 14A illustrates dot pitches in one line when driving is performed in the 2 phase excitation mode. FIG. 14B illustrates dot pitches when driving is performed in ½ step for one line according to the microstep drive. FIG. 14C illustrates dot pitches when driving is performed in ¼ step for one line according to the microstep drive. FIG. 14D illustrates dot pitches when driving is performed in ⅛ step for one line according to the microstep drive.

When the stepping motor is subjected to the 2 phase excitation, and then the paper feeding is performed accordingly, as shown in FIG. 14A, the paper is fed for one line (a distance indicated by the reference number 41 in the figure) every time when the phases are switched, and during the feeding, one-time energization is performed for the heating elements, thereby printing one dot 40. Therefore, in the case of the 2 phase excitation, one-time phase switching allows the paper to be fed for one dot pitch (a distance indicated by the reference number 42 in the figure).

On the other hand, when the paper feeding is performed by the microstep drive in ½ step, as shown in FIG. 14B, two times of ½ step within one line (a distance indicated by the reference number 41 in the figure) allows two times of paper feeding for a half of the line, and energization of the heating elements is performed during the paper feeding of each of the two times, thereby printing dots 43*a* and 43*b*. Therefore, in the case of the ½ step microstep drive, ½ step of the first time allows the paper feeding of the former step dot pitch (a distance indicated by the reference number 44*a* in the figure) and ½ step of the second time allows the paper feeding of the latter step dot pitch (a distance indicated by the reference number 44*b* in the figure). Consequently, paper feeding for the dot pitches corresponding to one line is performed by two times of ½ step.

When the paper feeding is performed by the microstep drive in ¼ step, as shown in FIG. 14C, four times of ¼ step within one line (a distance indicated by the reference number 41 in the figure) allows four times of paper feeding for a quarter of line, and energization of the heating elements is performed during the paper feeding of each of the four times, thereby printing dots 45*a* and 45*b*. Therefore, in the case of the ¼ step microstep drive, ¼ step of the first time allows the paper feeding for the dot pitch in the first step among the four steps (a distance indicated by the reference number 46*a* in the figure), ¼ step of the second time allows the paper feeding for the dot pitch in the second step among the four steps (a distance indicated by the reference number 46*b* in the figure), ¼ step of the third time allows the paper feeding for the dot pitch in the third step among the four steps (a distance indicated by the reference number 46*c* in the figure), and ¼ step of the fourth time allows the paper feeding for the dot pitch in the fourth step among the four steps (a distance indicated by the reference number 46*d* in the figure). Consequently, the paper feeding corresponding to one line is performed.

When the paper feeding is performed, by ⅛ step microstep drive, as shown in FIG. 14D, eight times of ⅛ step within one line (a distance indicated by the reference number 41 in the figure) allows the paper feeding corresponding to one line. Since the way of paper feeding is the same as the case of ½ step or ¼ case, explanation of the operation will not be tediously made here.

The microstep drive control circuit 23*d* selects the full step, ½ step, ¼ step, or ⅛ step, based on the division number of the segmented blocks, which is defined in the block segmentation processing circuit 22*a*. For example, as a threshold for performing the selection, a certain division number is set in advance, and the microstep drive control circuit compares the division number obtained in the block segmentation processing circuit 22*a* with the preset value which is set in advance, and generates an excitation signal for performing the full step, ½ step, ¼ step, or ⅛ step, based on the comparison result.

The carrier motor 18*a* of the paper carrier 18 is driven by the excitation signal selected based on the division number, which is outputted from the motor controller 23.

The energization ratio setting circuit 24*a* of the power feeding controller 24 sets an energization ratio of the energization amount that is applied to the heating elements at each time of paper feeding, when the paper feeding is performed in each divided step according to the microstep drive. This energization ratio setting circuit 24*a* defines the ratio of the energization amount to be supplied in each of the divided steps.

FIG. 15 illustrates the ratio of energization amount when the microstep drive in ½ step is performed. The energization ratio setting circuit 24*a* sets the ratio of the energization amount to be supplied in each of the former first ½ step and the latter second ½ step, based on the paper feeding speed.

The energization ratio is set in accordance with the paper feeding speed as the following: the energization ratio fed in the first ½ step is set to be higher, as the paper feeding speed becomes higher, in the range of 50% to 100% according to the speed variation from lower to higher; and on the other hand, the energization ratio fed in the second ½ step is set to be lower, as the paper feeding speed becomes higher, in the range of 50% to 0% according to the speed variation from lower to higher. It is to be noted here that the energization ratio during the period of the first ½ step and during the period of the second step are set in such a manner that the sum total of the rates becomes 100%, for instance. However, an exothermic efficiency may be deteriorated due to a divisional energization. Considering such a case above, the sum total of the energization ratio may be set to 100% or higher.

FIG. 15C illustrates an example in which the energization ratio is set to be 50:50. FIG. 15D illustrates an example in which the energization ratio is set to be 80:20.

When the microstep drive is performed in ¼ step or ⅛ step, the energization ratio may be set with respect to each segmented steps. It is further possible to divide each of the segmented step into the former half and the latter half, and set the energization ratio for each of the former half and the latter half.

Figures 16A, 16B, 16C:
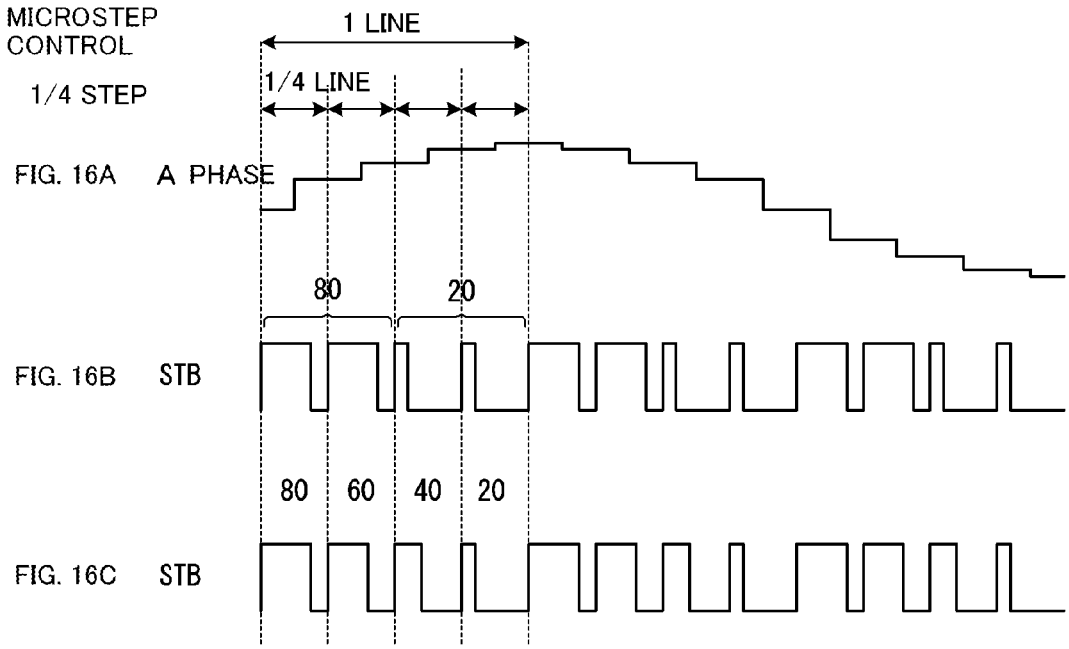
FIGS. 16A to 16C illustrate a ratio of energization amount in ¼ step of the microstep drive according to the present invention.
Figure 17:
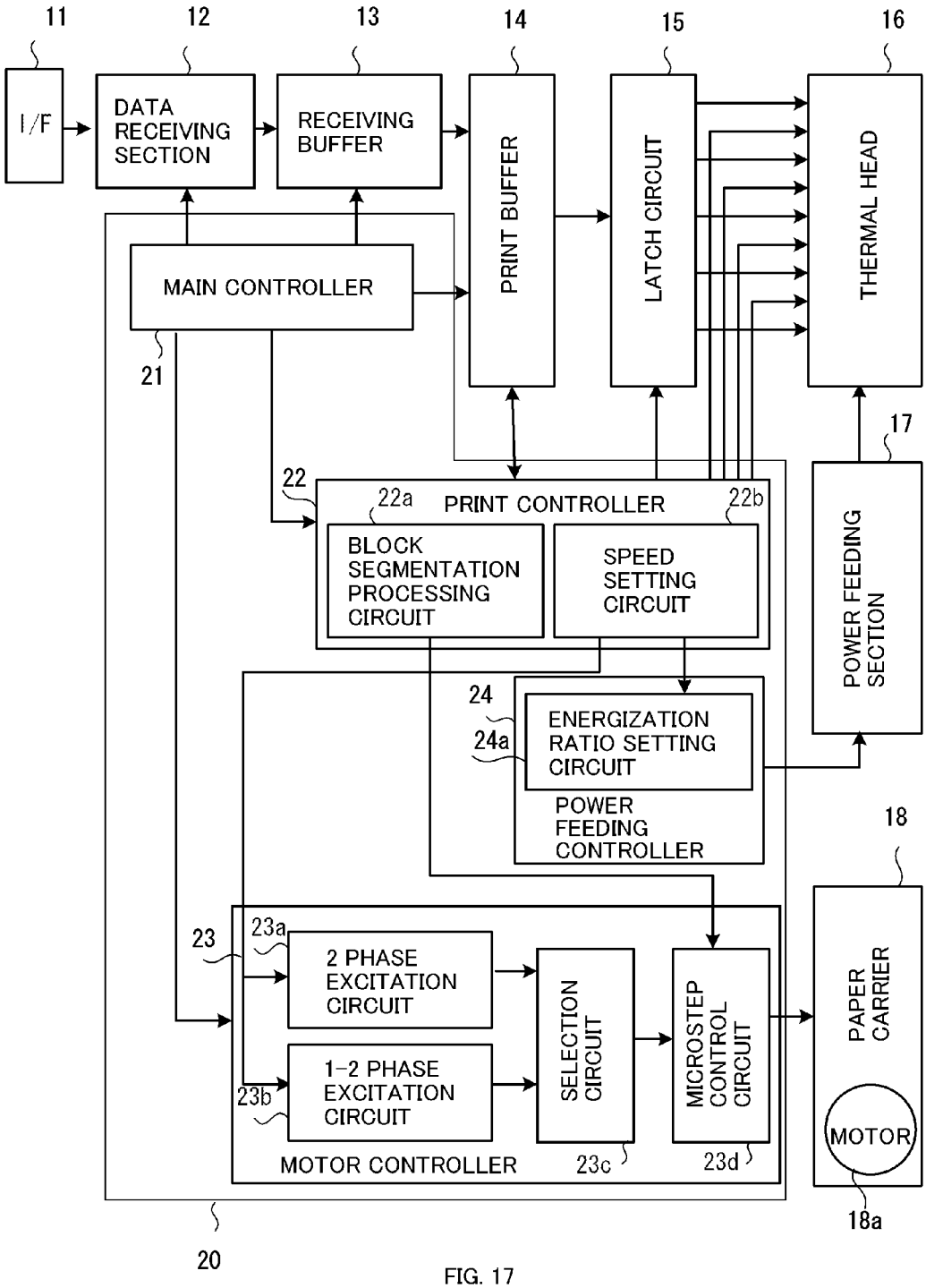
FIG. 17 is a schematic functional diagram in the case where the 1-2 phase excitation mode and the microstep drive are combined.
Figure 18B:
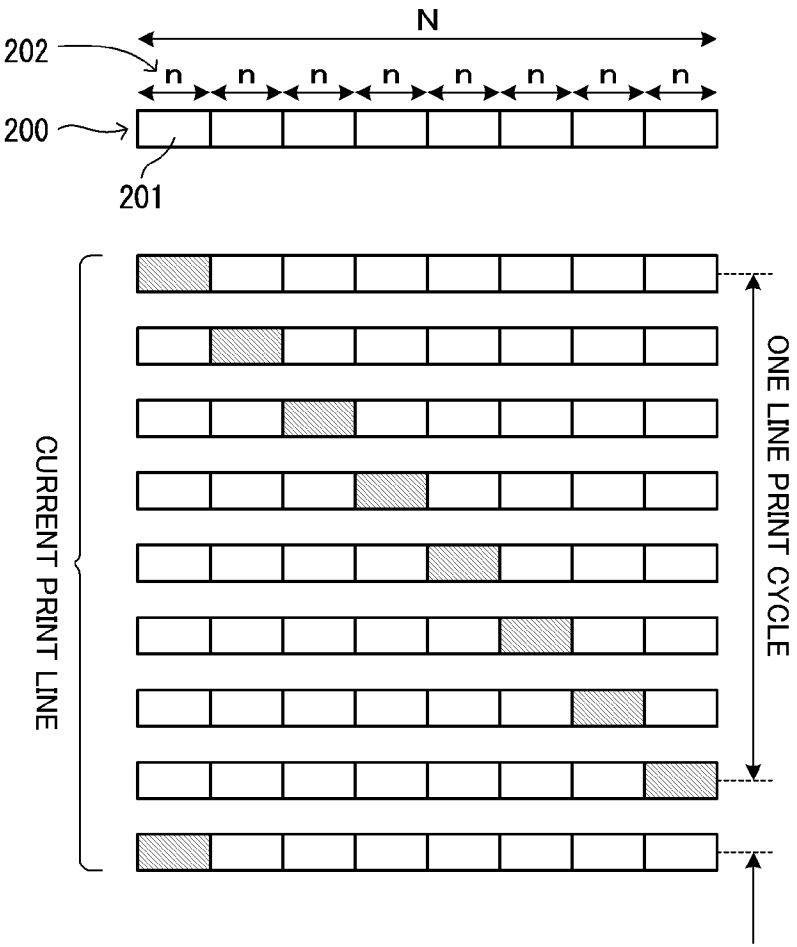
FIGS. 18A and 18B illustrate driving of a thermal head according to segmented blocks.
Figure 18A:
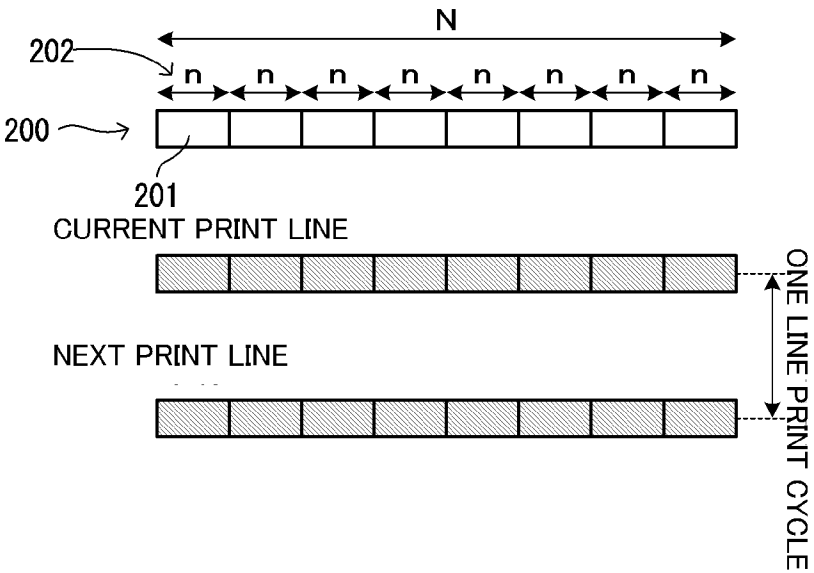
Figure 19A:
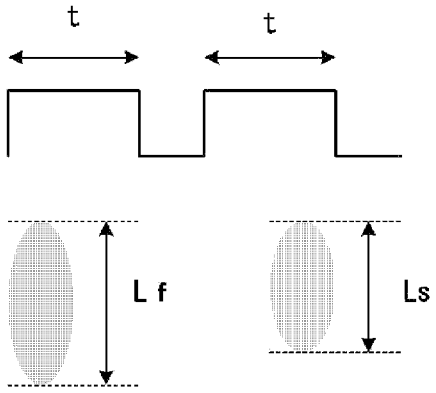
FIGS. 19A to 19D illustrate fluctuations of print length, when the speed is made variable.
Figure 19C:
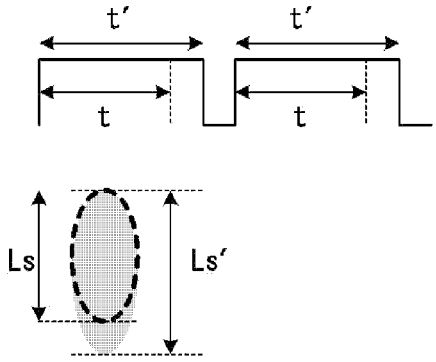
Figure 19B:
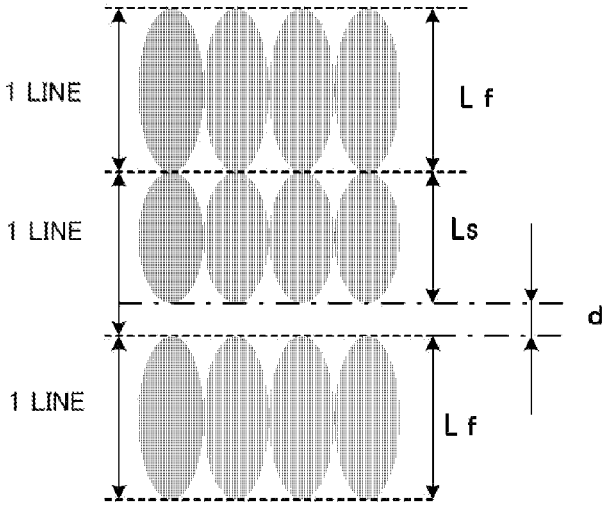
Figure 19D:
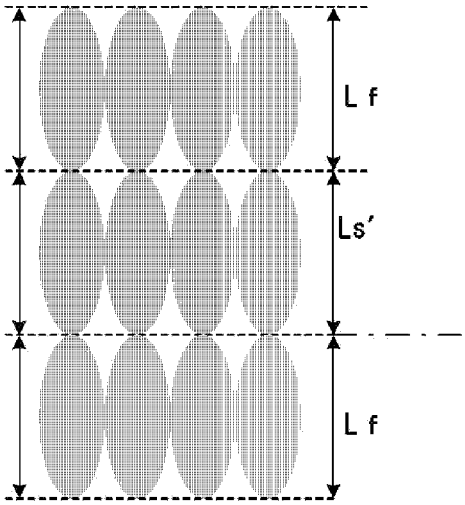
Figure 20A:
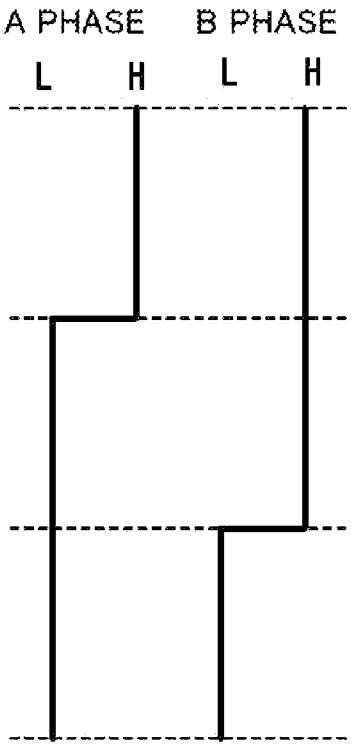
FIGS. 20A to 20C illustrate a printing state at the time of low-speed rotation.
Figure 20B:
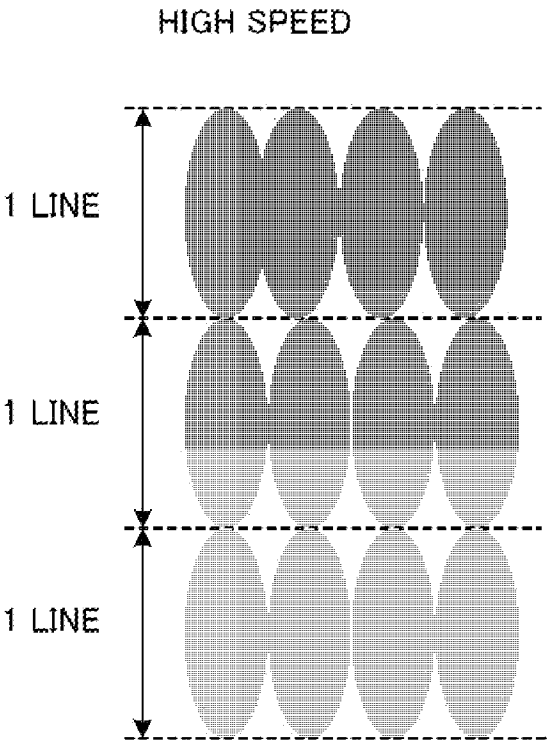
Figure 20C:
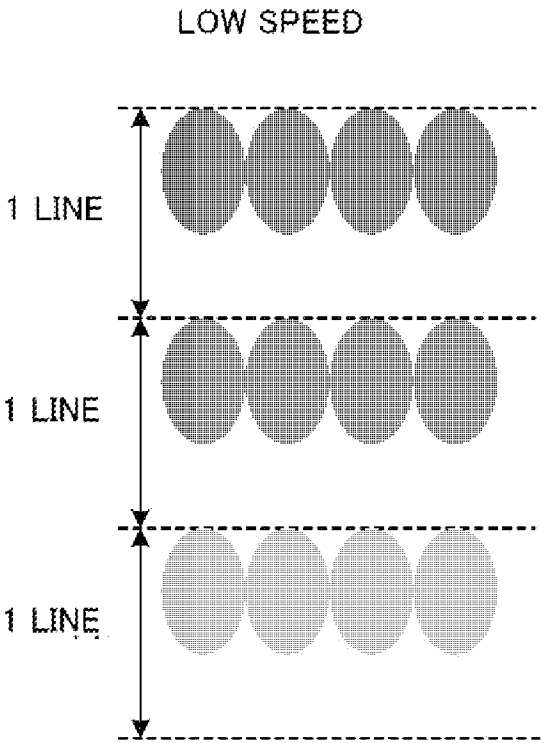

FIG. 16 illustrates the energization ratio when the microstep drive is performed in ¼ step. FIG. 16B shows an example that divides the segmented steps into the former half and the latter half, and the energization ratio is set for each of the former half and the latter half. Here, the energization ratio between the former half and the latter half is set to be 80:20. FIG. 16C shows an example that sets the energization ratio with respect to each of the segmented steps. Here, the energization ratio of each of the segmented steps, four ¼ steps, is set to be 80:60:40:20. Here, total sum of the energization ratio is set to be equal to or higher than 100%.

Figure 8:
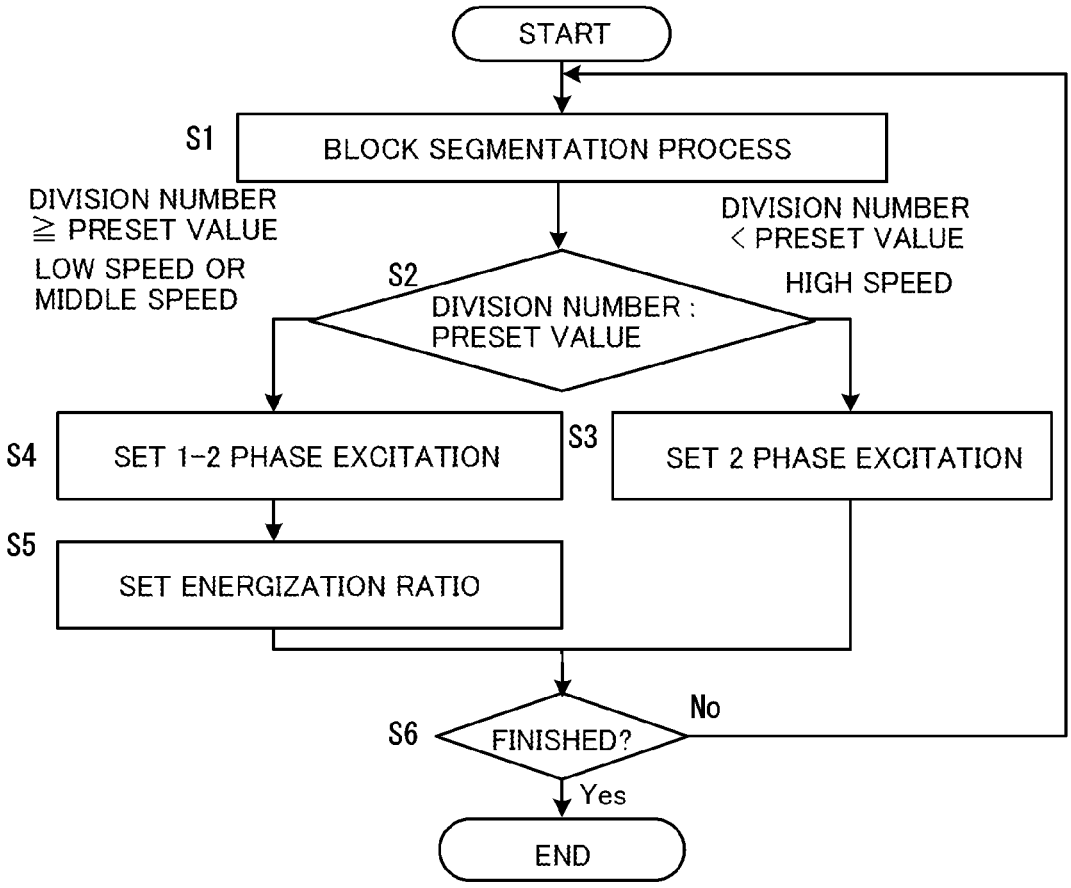
FIG. 8 is a flowchart to explain a procedure for setting a paper feeding speed and for setting the energization ratio by switching the excitation modes of a printer according to the present invention.

In the case of the microstep drive according to the present invention, a procedure for setting the paper feeding speed and the energization ratio may be the same as the procedure of the flowchart shown FIG. 8 described above, by replacing the 1-2 phase excitation setting in S4 step with the microstep drive setting. Therefore, detailed explanation will not be made here.

In each of the examples described above, as for the motor control, there have been shown examples of the 1-2 phase excitation mode (the configuration example shown in FIG. 1) and the microstep drive (the configuration example shown in FIG. 11). However, it is further possible to combine both of the drive modes; the 1-2 phase excitation and the microstep drive. FIG. 17 is a diagram showing schematic functions of the thermal printer in the case where the 1-2 phase excitation mode and the microstep drive are combined.

The motor controller 23 shown in FIG. 17 is provided with the 2 phase excitation circuit 23*a*, the 1-2 phase excitation circuit 23*b*, the selection circuit 23*c*, and the microstep control circuit 23*d*.

In this configuration example, the selection circuit 23*c* selects either of the 2 phase excitation signal and the 1-2 phase excitation signal. The microstep control circuit 23*d* performs the microstep control on the excitation signal having been selected, thereby driving the motor.

According to the configuration above, each of the following aspects of the invention can be established: an aspect for generating an excitation signal by the full step from the 2 phase excitation signal, an aspect for generating an excitation signal by the segmented steps; ½ step, ¼ step, ⅛ step, and the like, from the 2 phase excitation signal, an aspect for generating an excitation signal by the full step from the 1-2 phase excitation signal, and an aspect for generating an excitation signal by the segmented steps; ½ step, ¼ step, ⅛ step, and the like, from the 1-2 phase excitation signal. Among those signals above, the excitation signal generated in the full step from the 2 phase excitation signal has the lowest drive frequency, and the excitation signal generated in ⅛ step from the 1-2 phase excitation signal has the highest drive frequency.

INDUSTRIAL APPLICABILITY

The thermal printer according to the present invention can be applied to a small-sized electronic hardware, such as a portable information terminal.

What is claimed is:

1. A thermal printer comprising, a thermal head enabled to be driven by segmenting multiple heating elements into one or multiple blocks according to a quantity of the heating elements to be driven, the heating elements being connected with one another in the form of a line and allowed to be energized simultaneously;

a paper carrier for feeding paper to the thermal head;

a power feeding section for feeding power into the heating elements of the thermal head, with respect to each of the blocks being segmented, and a controller for controlling the paper carrier and the power feeding section, wherein, without changing a width of one line in a paper feeding direction, in response to one directive of power feeding for one line, the controller forms multiple dots in the paper feeding direction in one line, in such a manner that the number of dots positively correlates with a division number corresponding to the number of the multiple blocks being segmented, the paper carrier changes, with respect to each line, a dot pitch of the multiple dots in one line of a length in the paper feeding direction, in such a manner that a product of the quantity of dots and the dot pitch agrees with a width of one line in the paper feeding direction, and the power feeding section feeds each of the dot pitch in one line, allowing an energization amount of a former dot pitch to be the same as or larger than the energization amount of a latter dot pitch.

2. A thermal printer comprising, a thermal head enabled to be driven by segmenting multiple heating elements into one or multiple blocks according to a quantity of the heating elements to be driven, the heating elements being connected with one another in the form of a line and allowed to be energized simultaneously;

a paper carrier for feeding paper to the thermal head;

a power feeding section for feeding power into the heating elements of the thermal head, with respect to each of the blocks being segmented, and a controller for controlling the paper carrier and the power feeding section, wherein, without changing a width of one line in the paper feeding direction, in response to one directive of power feeding for one line, the controller compares the division number corresponding to the number of multiple blocks being segmented, with a preset value, when the division number is smaller than the preset value, the paper feeding of one line is performed in one dot pitch, and one-time power feeding for one dot pitch is performed as to each of the blocks within one line, when the division number is equal to or larger than the preset value, one line is divisionally driven and paper feeding is performed in multiple dot pitches, and more than once power feeding is performed respectively for the multiple dot pitches as to each of the blocks in one line, and an energization amount for a former dot pitch is set to be equal or larger than the energization amount of a latter dot pitch.

3. The thermal printer according to claim 1 or 2, wherein, the paper carrier comprises a stepping motor, and the controller comprises a motor controller for controlling drive of the stepping motor, wherein, the motor controller compares the division number with the preset value, drives the stepping motor in a 2 phase excitation mode, when the division number is smaller than the preset value, so as to perform paper feeding for printing in one dot pitch for one line and perform one-time power feeding for one dot pitch, as to each of the blocks in one line, and drives the stepping motor divisionally, when the division number is equal to or larger than the preset value, so as to perform paper feeding in multiple dot pitches for one line and perform power feeding more than once for printing, respectively for the multiple dot pitches, as to each of the blocks in one line.

4. The thermal printer according to claim 3, wherein, when the division number is equal to or larger than the preset value, the motor controller performs, either of;

a paper feeding control for feeding paper in two times of dot pitch for one line, according to a divisional drive in a 1-2 excitation mode, and a paper feeding control for feeding paper in n times of dot pitch for one line (n is positive integer), according to the divisional drive using a microstep drive.

5. The thermal printer according to claim 3, wherein, when the division number is equal to or larger than the preset value, the motor controller performs;

a paper feeding control for feeding paper in two times of dot pitch for a line, according to a divisional drive in a 1-2 excitation mode, and in the paper feeding control in each of the two times of dot pitch, a paper feeding control for feeding paper by a distance of 1/n (n is positive integer) for each dot pitch, according to the divisional drive using the microstep drive.

6. The thermal printer according to claim 1 or 2, wherein, the controller comprises a power feeding controller for controlling power feeding amount to be supplied to the power feeding section, wherein, the power feeding controller controls the feeding amount as to each paper feeding pitch within one line, according to the paper feeding speed.

7. The thermal printer according to claim 6, wherein, the power feeding controller comprises an energization ratio setting circuit for setting a ratio of energization amount to be fed in each paper feeding pitch within one line, wherein, the energization ratio setting circuit sets the ratio of the energization amount to be fed while driving in the divisional drive, according to the paper feeding speed.

8. The thermal printer according to claim 7, wherein, the energization ratio setting circuit sets in the 1-2 phase excitation mode, a ratio between the energization amount in the dot pitch of a former step and the energization amount in the dot pitch of a latter step, according to the paper feeding speed.

9. The thermal printer according to claim 8, wherein, the energization ratio setting circuit sets the ratio of energization to be fed in the dot pitch of the former step in stepwise in the range from 50% to 100%, according to the paper feeding speed.

10. The thermal printer according to claim 8, wherein, the energization ratio setting circuit sets the ratio of energization to be fed in the dot pitch of the former step gradually in the range from 50% to 100%, according to the paper feeding speed.

11. The thermal printer according to claim 8, wherein, the energization ratio setting circuit sets an energization time, and sets the energization time in the dot pitch of the latter step to be shorter than the energization time in the dot pitch of the former step.

12. The thermal printer according to claim 8, wherein, the energization ratio setting circuit sets a current value and sets the current value in the dot pitch of the latter step to be smaller than the current value in the dot pitch of the former step.

13. The thermal printer according to claim 7, wherein, the energization ratio setting circuit sets in the microstep drive, the ratio of the energization amount to be fed in each step within one dot pitch, according to the paper feeding speed.

14. The thermal printer according to claim 13, wherein, the energization ratio setting circuit sets the ratio of energization to be fed in a first step in one dot pitch in stepwise in the range from 50% to 100%, according to the paper feeding speed.

15. The thermal printer according to claim 13, wherein, the energization ratio setting circuit sets the ratio of energization to be fed in a first step in one dot pitch gradually in the range from 50% to 100%, according to the paper feeding speed.

16. The thermal printer according to claim 13, wherein, the energization ratio setting circuit sets an energization time, and sets the energization time from a second step to be shorter than the energization time of the first step.

17. The thermal printer according to claim 13, wherein, the energization ratio setting circuit sets a current value and sets the current value from the second step to be smaller than the current value of the first step.

* * * * *